US010851776B2

(12) United States Patent
Okuyama et al.

(10) Patent No.: US 10,851,776 B2
(45) Date of Patent: Dec. 1, 2020

(54) SLIDING MEMBER AND SLIDING MACHINE

(71) Applicants: KABUSHIKI KAISHA TOYOTA CHUO KENKYUSHO, Nagakute (JP); JTEKT CORPORATION, Osaka (JP)

(72) Inventors: Masaru Okuyama, Nagakute (JP); Hiroyuki Mori, Nagakute (JP); Mamoru Tohyama, Nagakute (JP); Noriyuki Emoto, Okazaki (JP); Naohito Yoshida, Takahama (JP)

(73) Assignees: KABUSHIKI KAISHA TOYOTA CHUO KENKYUSHO, Nagakute (JP); JTEKT CORPORATION, Osaka (JP)

( * ) Notice: Subject to any disclaimer, the term of this patent is extended or adjusted under 35 U.S.C. 154(b) by 211 days.

(21) Appl. No.: 16/239,015

(22) Filed: Jan. 3, 2019

(65) Prior Publication Data

US 2019/0323498 A1 Oct. 24, 2019

(30) Foreign Application Priority Data

Apr. 20, 2018 (JP) ..... 2018-081180

(51) Int. Cl.
*F04C 2/344* (2006.01)
*C10M 169/04* (2006.01)
(Continued)

(52) U.S. Cl.
CPC ..... *F04C 2/344* (2013.01); *C10M 169/04* (2013.01); *C10M 2201/04* (2013.01);
(Continued)

(58) Field of Classification Search
CPC . F04C 2/344; C10N 2040/44; C10N 2020/06; C10N 2020/061; C10N 2030/06;
(Continued)

(56) References Cited

U.S. PATENT DOCUMENTS 8,561,707 B2 * 10/2013 Jin ..... C23C 16/0272 166/380
9,051,967 B2 * 6/2015 Inami ..... F16C 33/00
(Continued)

FOREIGN PATENT DOCUMENTS

JP H08-177772 A 7/1996
JP 2011-32429 A 2/2011
(Continued)

*Primary Examiner* — Mary Davis
(74) *Attorney, Agent, or Firm* — Oliff PLC

(57) ABSTRACT

A sliding member has a sliding surface sliding under a wet condition in which a lubricant oil exists. The sliding surface is coated with a laminate film comprising an upper layer and a lower layer. The lower layer comprises hydrogen-free amorphous carbon (hydrogen-free DLC) and carbon particles dispersed on or in the hydrogen-free DLC. The hydrogen-free DLC has a hydrogen content of 5 atom % or less when the lower layer as a whole is 100 atom %. The upper layer comprises boron-containing amorphous carbon (B-DLC) and has protrusions on a surface side of the upper layer along the carbon particles of the lower layer. The B-DLC has a boron content of 1-40 atom % when the upper layer as a whole is 100 atom %. The protrusions have a particle diameter of 0.5-5 μm and exist with a density of 20 protrusions/100 $\mu m^2$ or more.

8 Claims, 23 Drawing Sheets

4-1) Fine-particle-rich laminate film (example)

4-2) Fine-particle-poor laminate film (comparative example)

4-3) Single-layer film (comparative example)

(51) Int. Cl.

| | |
|---|---|
| ***C10N 20/00*** | (2006.01) |
| ***C10N 20/06*** | (2006.01) |
| ***C10N 30/06*** | (2006.01) |
| ***C10N 40/00*** | (2006.01) |
| ***C10N 50/00*** | (2006.01) |

(52) U.S. Cl.
CPC . *C10M 2201/041* (2013.01); *C10M 2227/066* (2013.01); *C10N 2020/06* (2013.01); *C10N 2020/061* (2020.05); *C10N 2030/06* (2013.01); *C10N 2040/00* (2013.01); *C10N 2040/44* (2020.05); *C10N 2050/025* (2020.05)

(58) Field of Classification Search
CPC ..... C10N 2040/00; C10N 2050/025; C10M 169/04; C10M 2201/04; C10M 2201/041; C10M 2227/066
See application file for complete search history.

(56) References Cited

U.S. PATENT DOCUMENTS

| | | | | |
|---|---|---|---|---|
| 9,624,975 | B2 | 4/2017 | Okuyama et al. | |
| 9,759,323 | B2 | 9/2017 | Higuchi et al. | |
| 2015/0036962 | A1* | 2/2015 | Ogahara ..... | F16C 33/043 384/625 |
| 2015/0267746 | A1 | 9/2015 | Okuyama et al. | |
| 2015/0362072 | A1 | 12/2015 | Higuchi et al. | |
| 2017/0335964 | A1 | 11/2017 | Higuchi et al. | |

FOREIGN PATENT DOCUMENTS

| | | | |
|---|---|---|---|
| JP | 2014-145098 | A | 8/2014 |
| JP | 2014-224239 | A | 12/2014 |
| JP | 2015-193918 | A | 11/2015 |
| JP | 2017-133574 | A | 8/2017 |

* cited by examiner (Rotation speed 1200 rpm, main oil pressure 0.8 MPa, oil temperature 80°C)

FIG.4
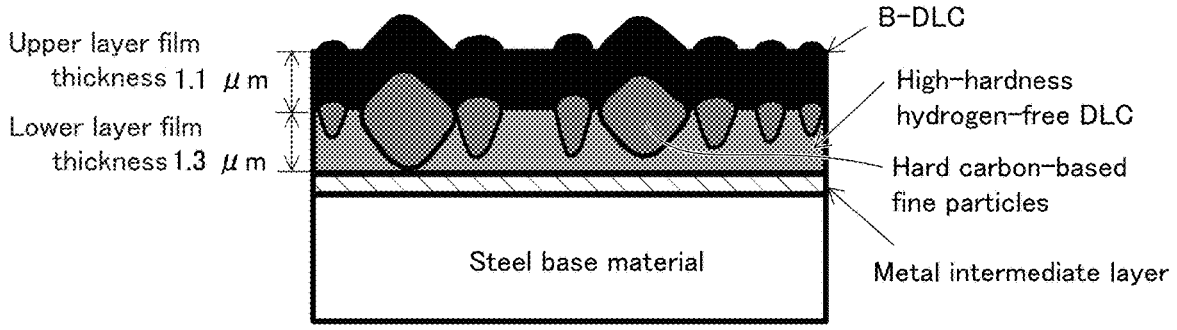
4-1) Fine-particle-rich laminate film (example)
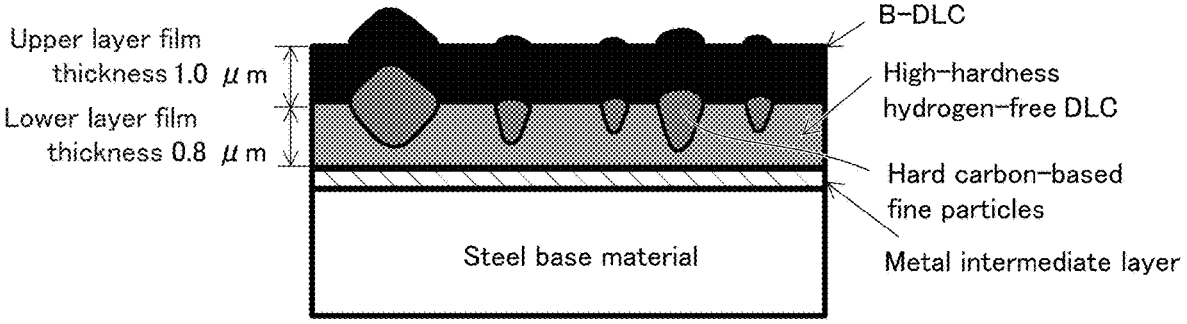
4-2) Fine-particle-poor laminate film (comparative example)
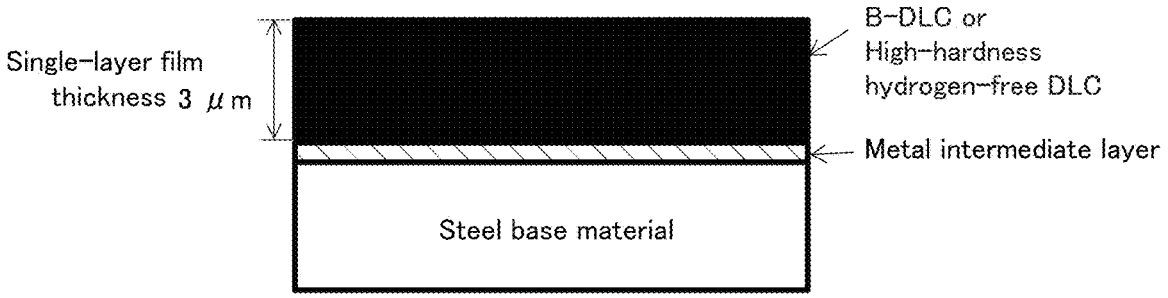
4-3) Single-layer film (comparative example)

FIG.5
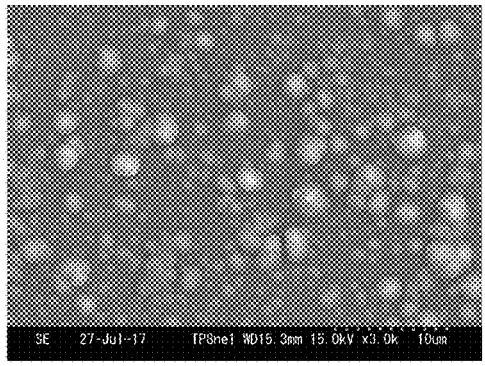
5-1) Fine-particle-rich laminate B-DLC film
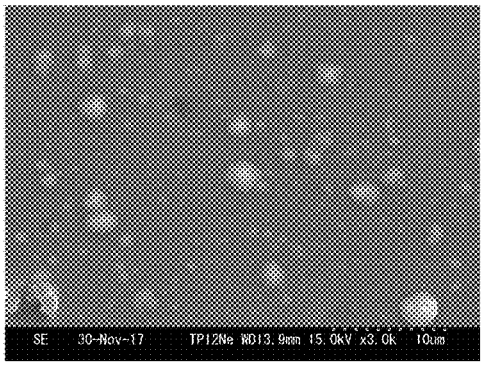
5-2) Fine-particle-poor laminate B-DLC film
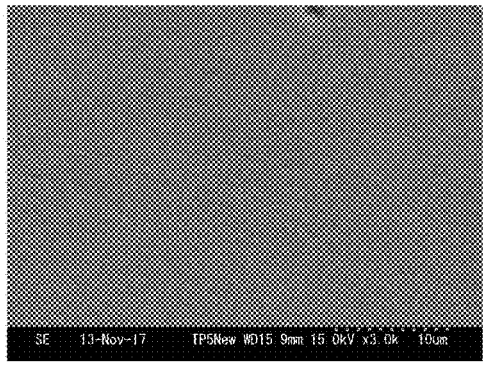
5-3) Single-layer B-DLC film
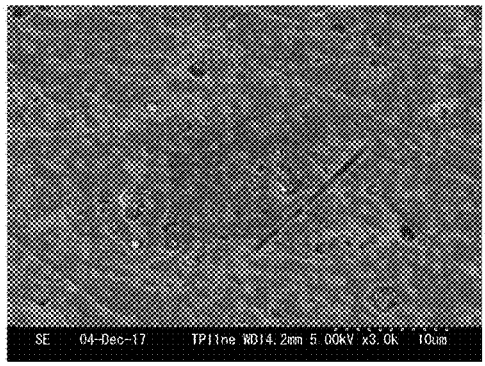
5-4) Single-layer hydrogen-free DLC film FIG.8
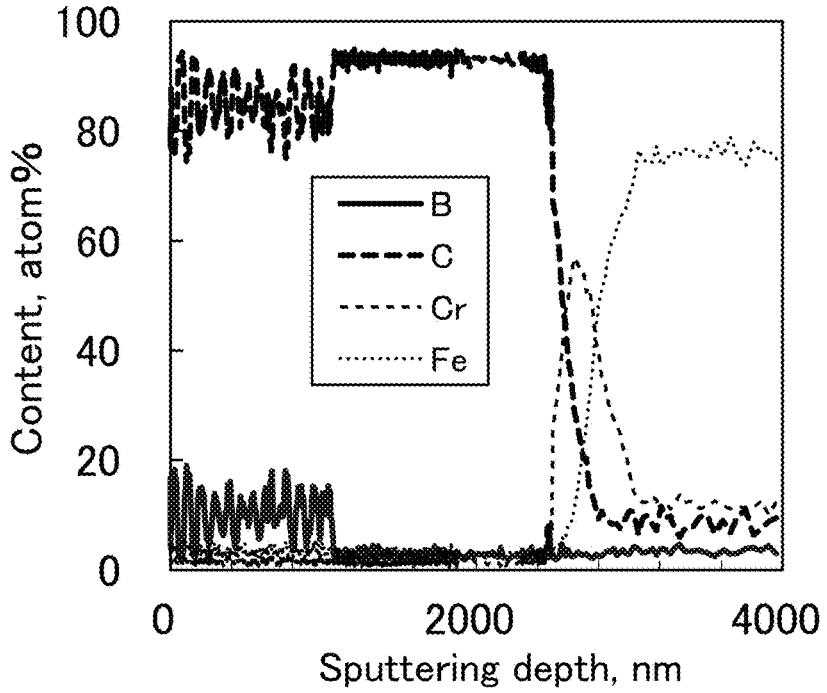
8-1) Fine-particle-rich laminate B-DLC film
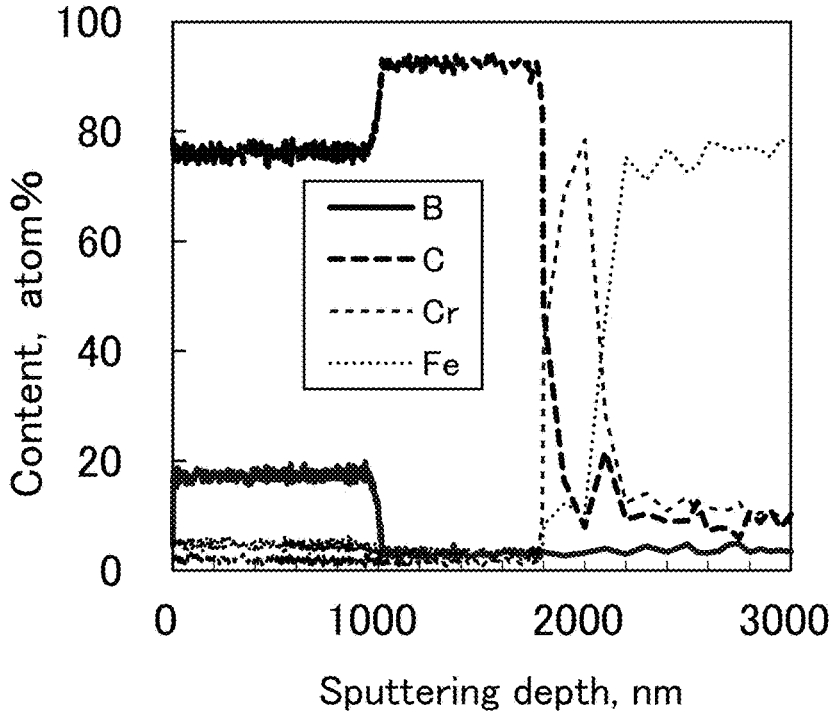
8-2) Fine-particle-poor laminate B-DLC film FIG.9
9-1) Site 1 (large-diameter particle part)
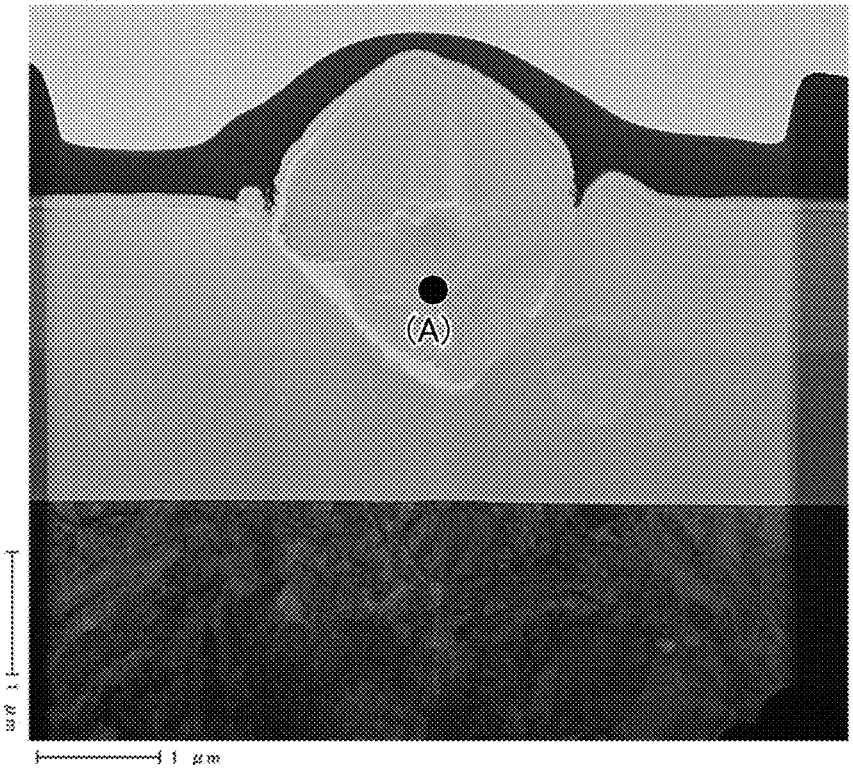
9-2) Site 2 (small-diameter particle part)
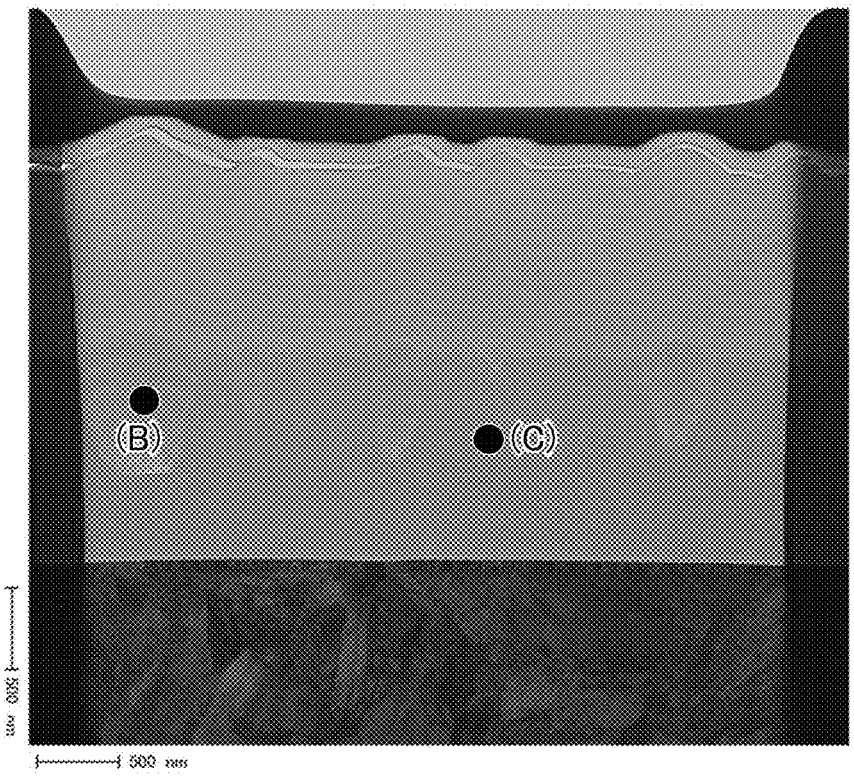

FIG.11
11-1) (A) of FIG. 9-1, Fine particle part of about 2 μm Φ
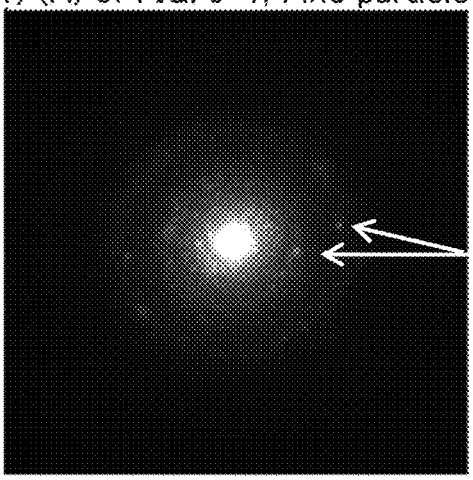
Crystal structure pattern
11-2) (B) of FIG. 9-2, Fine particle part of about 0.5 μm Φ
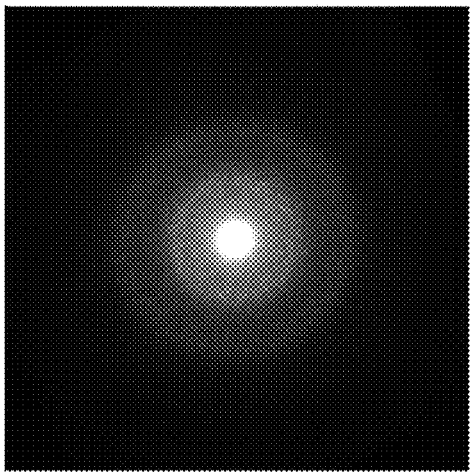
11-3) (C) of FIG. 9-2, Lower layer hydrogen-free DLC film part
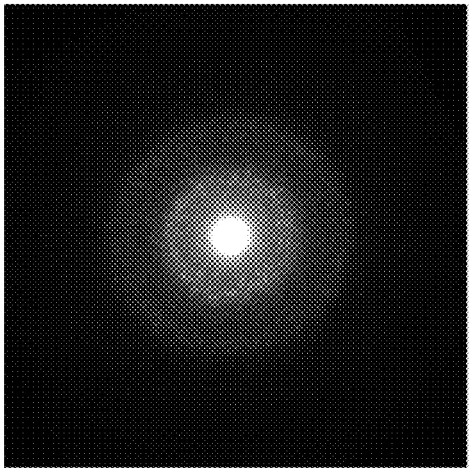

FIG.12

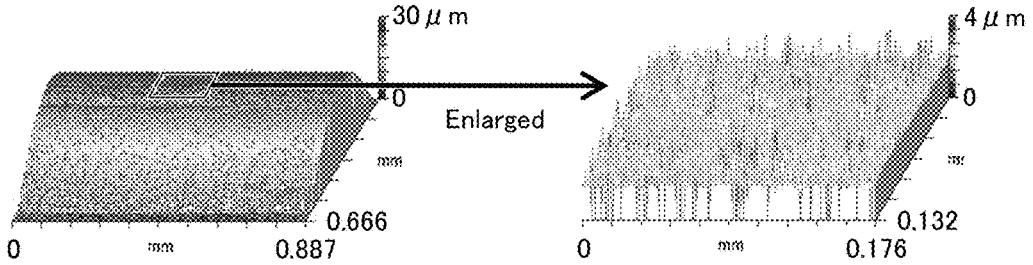

Surface roughness (high-pass cutoff 0.08 mm, orthogonal to sliding direction, average of 5 points)
Ra0.089 μm, Rz1.291 μm, Rpk0.455 μm 12-1) Vane coated with fine-particle-rich laminate B-DLC film (before test)

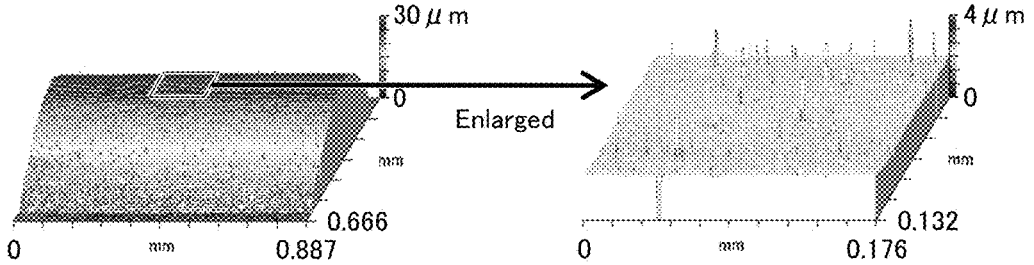

Surface roughness (high-pass cutoff 0.08 mm, orthogonal to sliding direction, average of 5 points)
Ra0.041 μm, Rz0.567 μm, Rpk0.135 μm 12-2) Vane coated with fine-particle-poor laminate B-DLC film (before test)

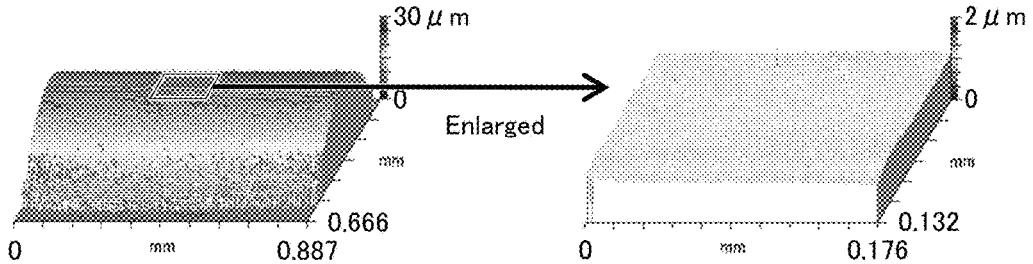

Surface roughness (high-pass cutoff 0.08 mm, orthogonal to sliding direction, average of 5 points)
Ra0.019 μm, Rz0.138 μm, Rpk0.021 μm 12-3) Vane coated with single-layer B-DLC film (before test)

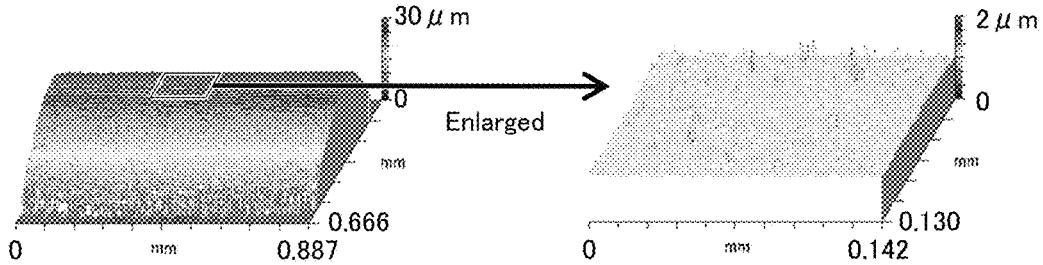

Surface roughness (high-pass cutoff 0.08 mm, orthogonal to sliding direction, average of 5 points)
Ra0.025 μm, Rz0.243 μm, Rpk0.072 μm 12-4) Vane coated with single-layer hydrogen-free DLC film (before test)

FIG.13
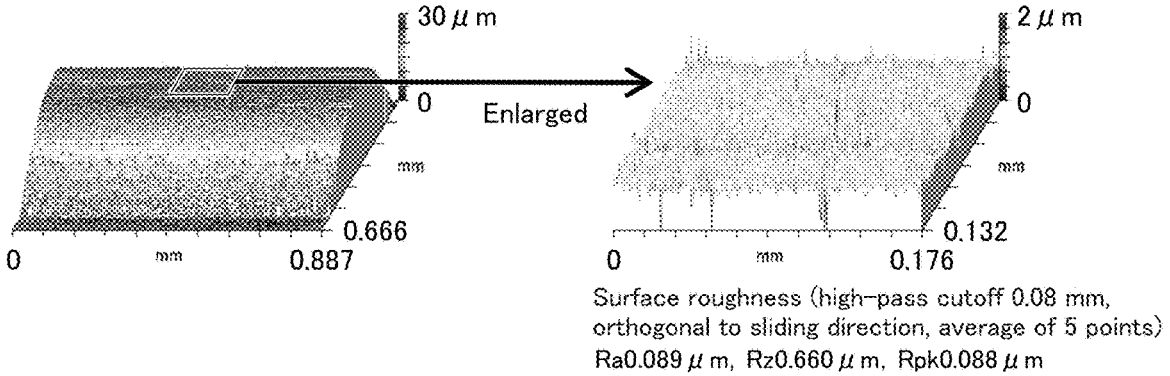
13-1) Vane of reference steel material (before test)
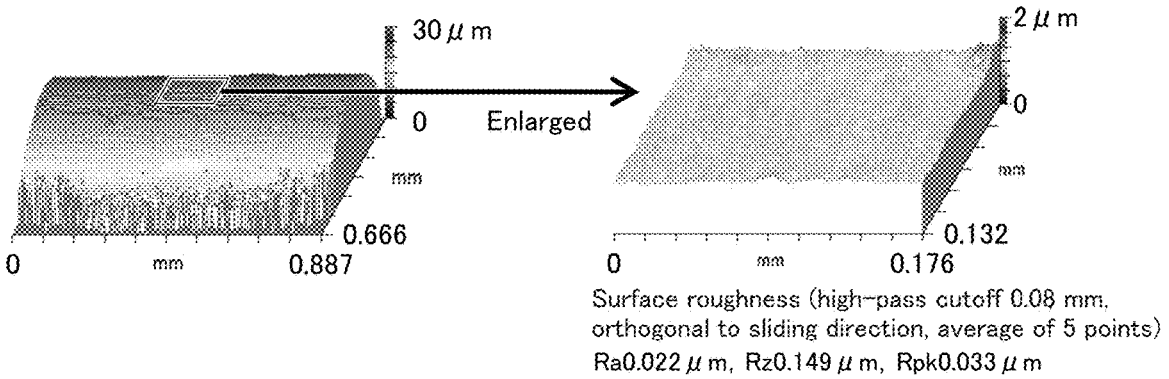
13-2) Vane of mirror-polished steel material (before test)
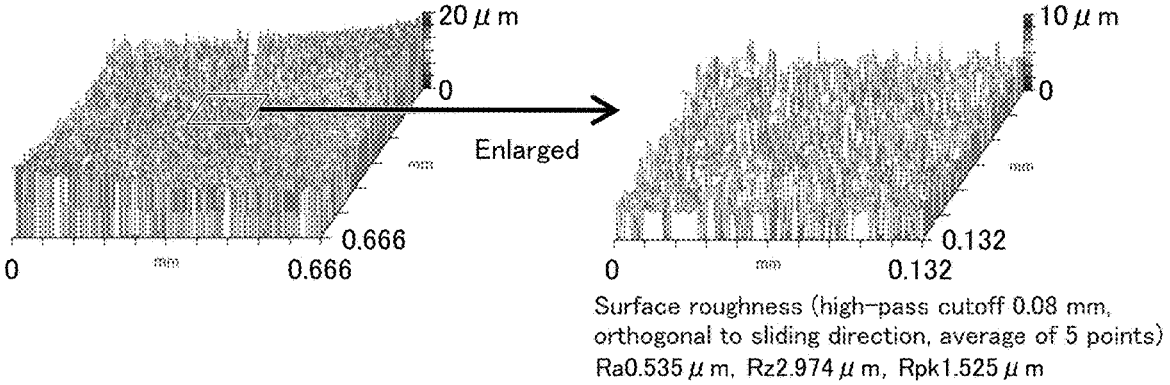
13-3) Cam ring (before test)

FIG.19

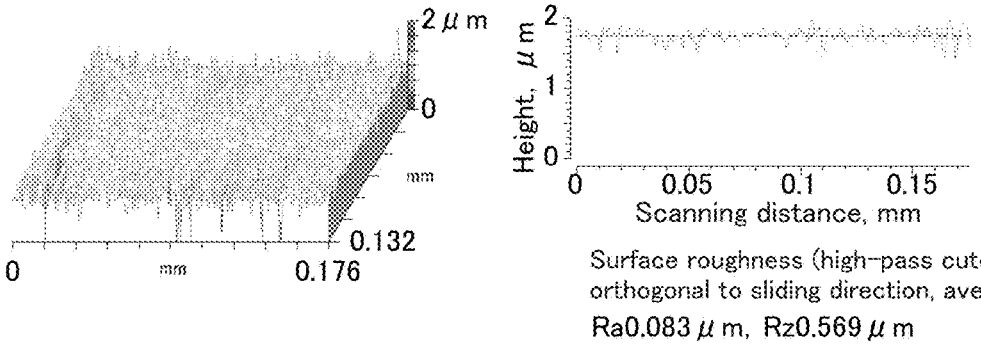

Surface roughness (high-pass cutoff 0.08 mm, orthogonal to sliding direction, average of 5 points)
Ra0.083 μm, Rz0.569 μm 19-1) Vane of reference steel material (after test)

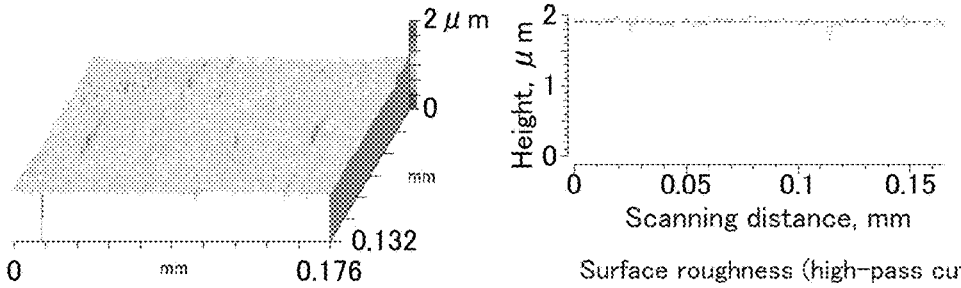

Surface roughness (high-pass cutoff 0.08 mm, orthogonal to sliding direction, average of 5 points)
Ra0.028 μm, Rz0.247 μm 19-2) Vane of mirror-polished steel material (after test)

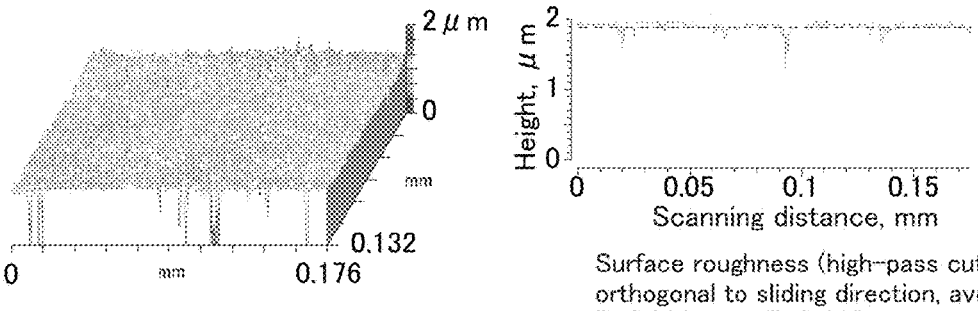

Surface roughness (high-pass cutoff 0.08 mm, orthogonal to sliding direction, average of 5 points)
Ra0.032 μm, Rz0.410 μm 19-3) Vane coated with fine-particle-rich laminate B-DLC film (after test)

FIG.20

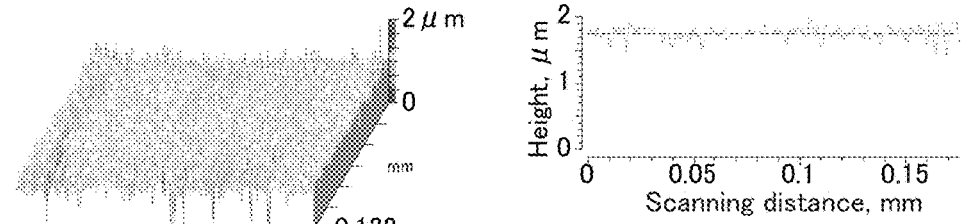

Surface roughness (high-pass cutoff 0.08 mm, orthogonal to sliding direction, average of 5 points)
Ra0.083 μm, Rz0.569 μm 20-1) Vane of reference steel material (after test)

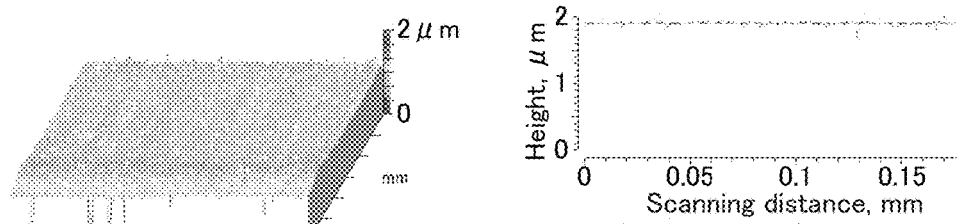

Surface roughness (high-pass cutoff 0.08 mm, orthogonal to sliding direction, average of 5 points)
Ra0.018 μm, Rz0.192 μm 20-2) Vane coated with fine-particle-rich laminate B-DLC film (after test)

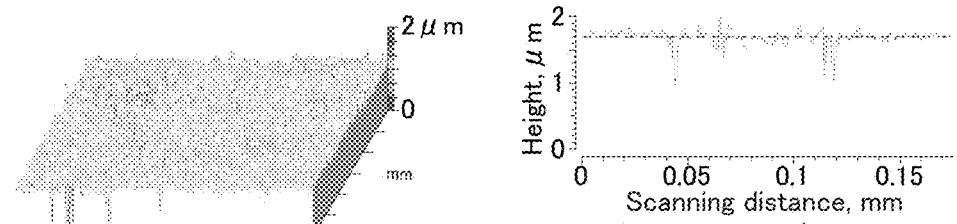

Surface roughness (high-pass cutoff 0.08 mm, orthogonal to sliding direction, average of 5 points)
Ra0.065 μm, Rz0.625 μm 20-3) Vane coated with fine-particle-poor laminate B-DLC film (before test)

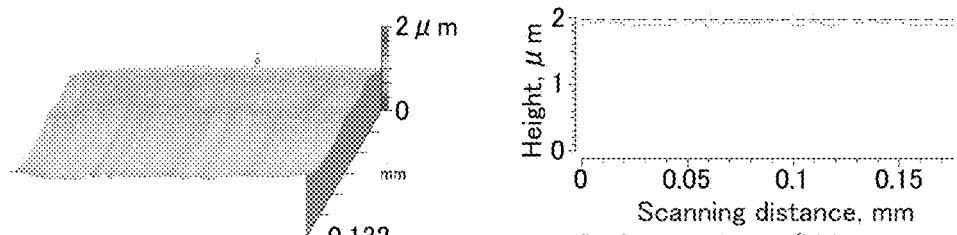

Surface roughness (high-pass cutoff 0.08 mm, orthogonal to sliding direction, average of 5 points)
Ra0.022 μm, Rz0.107 μm 20-4) Vane coated with single-layer B-DLC film (before test)

FIG.22

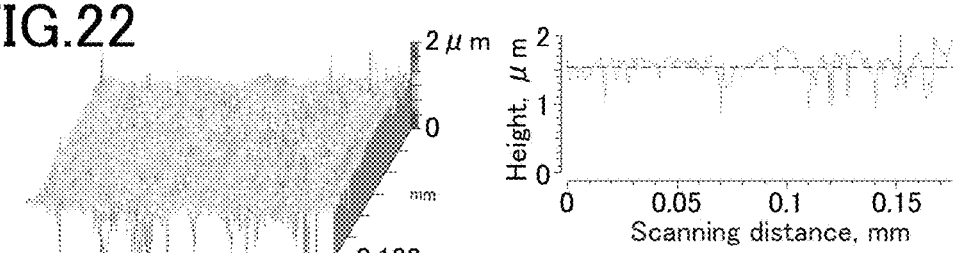

Surface roughness (high-pass cutoff 0.08 mm, orthogonal to sliding direction, average of 5 points)
Ra0.132 μm, Rz0.961 μm 22-1) After test using vane of reference steel material

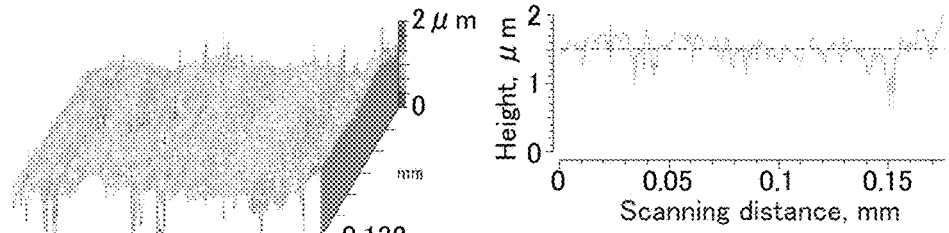

Surface roughness (high-pass cutoff 0.08 mm, orthogonal to sliding direction, average of 5 points)
Ra0.118 μm, Rz0.858 μm 22-2) After test using vane of mirror-polished steel material

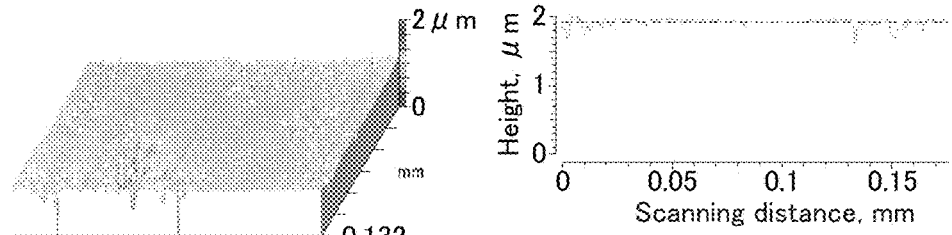

Surface roughness (high-pass cutoff 0.08 mm, orthogonal to sliding direction, average of 5 points)
Ra0.037 μm, Rz0.301 μm 22-3) After test using vane coated with fine-particle-rich laminate B-DLC film

FIG.23

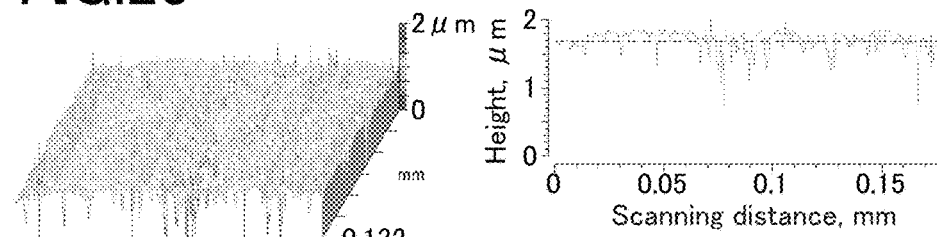

Surface roughness (high-pass cutoff 0.08 mm, orthogonal to sliding direction, average of 5 points)
Ra0.108 μm, Rz0.922 μm 23-1) After test using vane of reference steel material

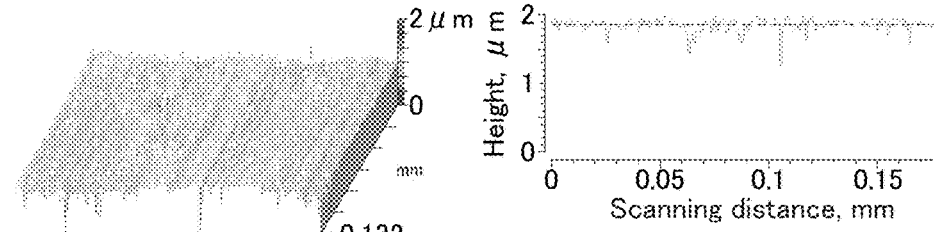

Surface roughness (high-pass cutoff 0.08 mm, orthogonal to sliding direction, average of 5 points)
Ra0.065 μm, Rz0.526 μm 23-2) After test using vane coated with fine-particle-rich laminate B-DLC film

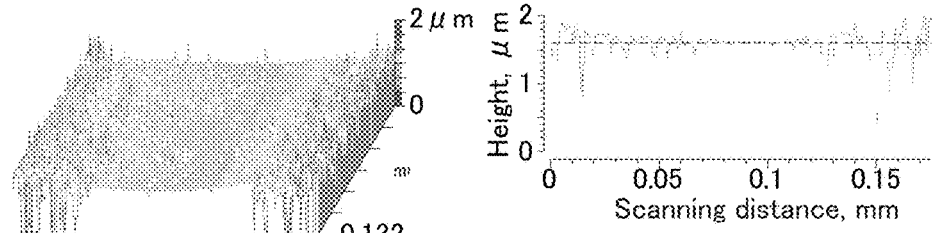

Surface roughness (high-pass cutoff 0.08 mm, orthogonal to sliding direction, average of 5 points)
Ra0.099 μm, Rz1.135 μm 23-3) After test using vane coated with fine-particle-poor laminate B-DLC film

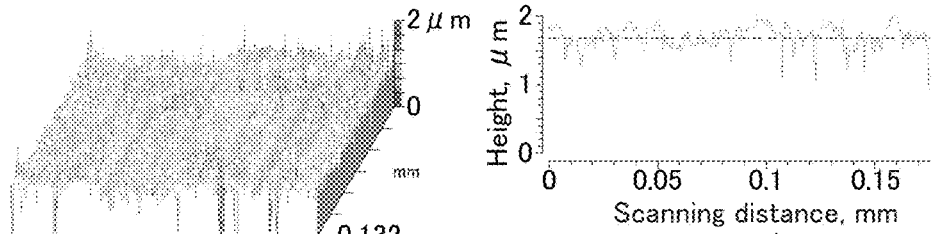

Surface roughness (high-pass cutoff 0.08 mm, orthogonal to sliding direction, average of 5 points)
Ra0.125 μm, Rz0.869 μm 23-4) After test using vane coated with single-layer B-DLC film R = hydrocarbyl Mo−Trinuclear

SLIDING MEMBER AND SLIDING MACHINE

TECHNICAL FIELD

The present invention relates to a sliding member that slides under the presence of a lubricant oil and relates also to relevant products.

BACKGROUND ART

To improve the fuel efficiency of automobiles, etc., the friction between sliding contact surfaces (including the friction between sliding surfaces) is being reduced. The friction coefficient between the sliding contact surfaces can largely depend on the surface properties of the sliding contact surfaces facing each other and the characteristics of the lubricant oil interposed between the sliding contact surfaces.

In this context, proposals have been made to coat the sliding surfaces of sliding members, which are used under the presence of a lubricant oil, with various amorphous carbon films (also simply referred to as "DLC films"), and relevant descriptions are presented in the following patent documents.

PRIOR ART DOCUMENTS

Patent Documents

[Patent Document 1] JP8-177772A
[Patent Document 2] JP2011-32429A
[Patent Document 3] JP2014-145098A
[Patent Document 4] JP2014-224239A
[Patent Document 5] JP2015-193918A
[Patent Document 6] JP2017-133574A

SUMMARY OF INVENTION

Technical Problem

Among the above-described patent documents, Patent Document 5 describes a sliding member in which the sliding surface is coated with a laminate film comprising an underlying layer composed of silicon-containing amorphous carbon (Si-DLC) and an uppermost layer composed of boron-containing amorphous carbon (B-DLC). Patent Document 6 describes an internal oil pump for wet-type continuously variable transmissions in which the sliding surface is coated with a B-DLC film. Note, however, that both of the above coating films are initially smoothened at the outermost surfaces.

The present invention has been created in view of such circumstances, and an object of the present invention is to provide a sliding member and relevant products with which the friction can be reduced by providing a sliding surface with a coating film having a novel and unconventional form.

Solution to Problem

As a result of intensive studies to solve the above technical problem, the present inventors have newly found that the friction of a sliding member can be reduced by coating the sliding surface with a laminate film having fine protrusions at least on the outermost surface at an early stage of sliding. Developing this achievement, the present inventors have accomplished the present invention as will be described hereinafter.

«Sliding Member»

(1) According to an aspect of the present invention, there is provided a sliding member having a sliding surface sliding under a wet condition in which a lubricant oil exists. The sliding surface is coated with a laminate film comprising an upper layer and a lower layer. The lower layer comprises hydrogen-free amorphous carbon (referred to as "hydrogen-free DLC") and carbon particles dispersed on or in the hydrogen-free DLC and has a hydrogen content of 5 atom % or less when the lower layer as a whole is 100 atom %. The upper layer comprises boron-containing amorphous carbon (referred to as "B-DLC") and has protrusions on a surface side of the upper layer along the carbon particles of the lower layer. The B-DLC has a boron content of 1-40 atom % when the upper layer as a whole is 100 atom %. The protrusions have a particle diameter of 0.5-5 μm and exist with a density of 20 protrusions/100 $\mu m^2$ or more.

(2) According to the sliding member of the present invention, it is possible to reduce the friction of the sliding surface and also to reduce the loss of a sliding machine using the sliding member.

The reason that such an excellent effect can be obtained is not sure, but it can be considered as follows. The development of the reduction in friction is considered to be attributable not only to the contribution of the B-DLC which constitutes the upper layer of the laminate film provided on the sliding surface but also to the influence of the protrusions which appear on the upper layer surface. For example, when the sliding machine including the sliding member of the present invention is operated under the presence of a lubricant oil, a large number of protrusions on the outermost surface side can smoothen the sliding surface of the counterpart material. Of course, at that time, the upper layer surface can also be smoothened. In this case, when a suitable period of time elapses from the start of operation of the sliding machine, the sliding surfaces facing each other are mutually smoothened, and the above-described reduction in friction can be achieved at a higher level. Even if the protrusions themselves wear on the upper layer side, hard carbon particles that support the protrusions can remain, so that the sliding surface provided with the laminate film can be suppressed from unduly wearing.

«Sliding Machine»

The present invention can also be perceived as a sliding machine using the above-described sliding member. That is, according to another aspect of the present invention, there is provided a sliding machine comprising a pair of sliding members having sliding surfaces that can relatively move while facing each other and a lubricant oil interposed between the sliding surfaces facing each other. At least one of the sliding members comprises the above-described sliding member.

«Others»

Unless otherwise stated, a numerical range "x-y" as referred to in the present description includes the lower limit x and the upper limit y. Any numerical value included in various numerical values or numerical ranges described in the present description may be selected or extracted as a new lower or upper limit, and any numerical range such as "a-b" can thereby be newly provided using such a new lower or upper limit.

BRIEF DESCRIPTION OF DRAWINGS

FIG. 4 is a set of schematic diagrams illustrating the cross-sectional structures of DLC films.

FIG. 5 is a set of SEM images of DLC films.

FIG. 8 is a set of composition distribution diagrams obtained by AES analysis on fine-particle-containing laminate films.

FIG. 9 is a set of TEM images when observing a cross section of a fine-particle-rich laminate B-DLC film.

FIG. 11 shows electron beam diffraction patterns of fine particle parts and a DLC film part of the fine-particle-rich laminate B-DLC film.

FIG. 12 is a set of diagrams illustrating the surface roughness profiles of vanes before the test.

FIG. 13 is a set of diagrams illustrating the surface roughness profiles of the vanes and a cam ring before the test.

FIG. 19 is a set of diagrams illustrating the surface roughness profiles of vanes after the oil pump test performed using a Mo-trinuclear free oil.

FIG. 20 is a set of diagrams illustrating the surface roughness profiles of vanes before and after the oil pump test performed using a Mo-trinuclear-containing oil.

FIG. 22 is a set of diagrams illustrating the surface roughness profiles of cam rings after the oil pump test performed using a Mo-trinuclear free oil.

FIG. 23 is a set of diagrams illustrating the surface roughness profiles of cam rings after the oil pump test performed using a Mo-trinuclear-containing oil.

EMBODIMENTS FOR CARRYING OUT THE INVENTION

Figure 1:
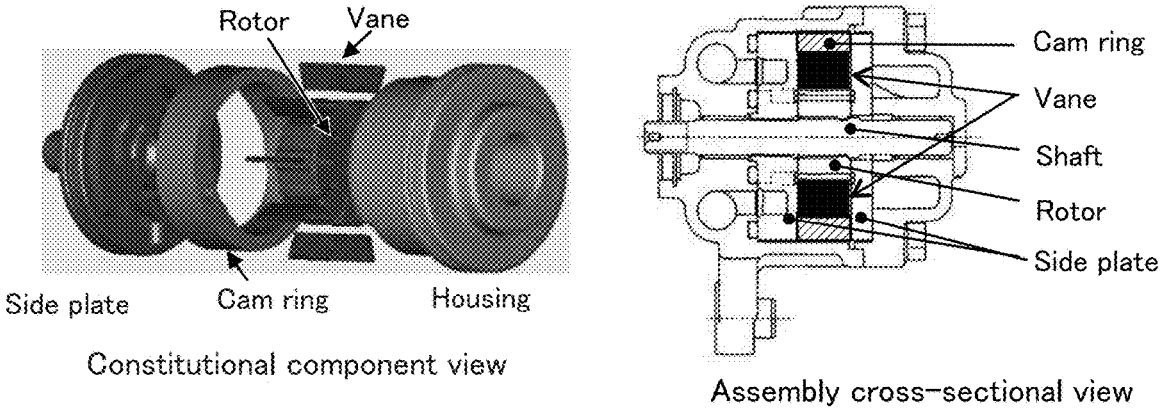
FIG. 1 is set of views illustrating the structure of a vane oil pump.

One or more features freely selected from the present description can be added to the above-described features of the present invention. The contents described in the present description can be applied not only to the sliding member of the present invention but also to a sliding machine (or a sliding system) using the sliding member. Which embodiment is the best or not is different in accordance with objectives, required performance, and other factors.

«Lower Layer»

The lower layer which constitutes the laminate film has hydrogen-free DLC and carbon particles dispersed on or in the hydrogen-free DLC.

(1) Hydrogen-Free DLC

When the lower layer as a whole is 100 atom %, the content of hydrogen (H) in the hydrogen-free DLC is 5 atom % or less and may be 3 atom % or less in an embodiment and 2 atom % or less in another embodiment. An unduly large amount of H softens the lower layer, which may not be preferred. The hydrogen-free DLC may preferably have hardness of 40-70 GPa in an embodiment and 50-65 GPa in another embodiment as measured by a nanoindenter.

The H content is quantified by analyzing the lower layer as a whole (in particular, the hydrogen-free DLC) using an elastic recoil detection analysis method (ERDA). Other elements than H (such as B) are quantified using an electron probe microanalysis method (EPMA). Unless otherwise stated, the composition ratio as referred to in the present description means atom %, which will also be expressed simply as "%."

The hydrogen-free DLC may contain modifying elements effective for improving the characteristics and/or impurities (incidental impurities) in addition to C and a small amount of H. Examples of the modifying elements include V, Ti, Mo, O, Al, Mn, Si, Cr, W, and Ni. The total amount of the modifying elements may preferably be less than 8 atom % in an embodiment and less than 4 atom % in another embodiment. The contents regarding the modifying elements are similarly applied to the carbon particles and the B-DLC, which will be described later.

(2) Carbon Particles

The carbon particles are composed primarily of C. The carbon particles may be amorphous particles or may also be particles having a crystal structure. Fine particles (particles having a particle diameter of less than 0.5 μm in an embodiment and 0.3 μm or less in another embodiment, for example) tend to have an amorphous structure similar to that of the hydrogen-free DLC. On the other hand, larger particles (particles having a particle diameter of 0.5 μm or more in an embodiment and 1 μm or less in another embodiment, for example) tend to have a crystal structure. Both the carbon particles have a C—C bond, but it tends to be a carbon bond different from that of the hydrogen-free DLC. This is understood from the following reasons.

In the carbon particles, for example, the position of the G-band peak among the Raman peaks obtained by visible light Raman spectroscopic analysis is within a range of 1530±10 $cm^{-1}$. This shifts by about 30 $cm^{-1}$ to the lower wavenumber side than the hydrogen-free DLC.

In the carbon particles having a relatively large particle diameter, the bond ratio ($\pi/(\pi+\sigma)$) representing the ratio of π bonds ($sp^2$ bonds) and σ bonds ($sp^3$ bond) of carbons obtained by the electron energy loss spectroscopy (EELS) can be 0.05 or more in an embodiment and 0.07 or more in another embodiment. This is considerably larger than the bond ratio of the hydrogen-free DLC of 0.041. In other words, the carbon particles having a crystal structure tend to have a considerably larger number of π bonds than that of the hydrogen-free DLC. Suffice it to say that the upper limit of the bond ratio may be 0.2 in an embodiment and 0.15 in another embodiment.

The particle diameter of the carbon particles may preferably correspond to those of the protrusions formed on the upper layer. The particle diameter of the carbon particles is, for example, 0.1-10 μm in an embodiment, 0.5-5 μm in another embodiment, and 1-4 μm in still another embodiment.

The carbon particles which cause the protrusions (particle diameter: 0.5-5 μm) to be formed may preferably exist with a density of 20 particles/100 $\mu m^2$ or more in an embodiment, 25 particles/100 $\mu m^2$ or more in another embodiment, and 30 particles/100 $\mu m^2$ or more in still another embodiment. The upper limit is not particularly defined, but suffice it to say that the upper limit may be 100 particles/100 $\mu m^2$ or less in an embodiment and 50 particles/100 $\mu m^2$ or less in another embodiment.

The particle diameter of the carbon particles can be controlled by adjusting the film thickness when forming the hydrogen-free DLC. In this regard, the film thickness of the hydrogen-free DLC may preferably be adjusted within a range of 0.1-10 μm in an embodiment, 0.5-5 μm in another embodiment, and 1-4 μm in still another embodiment.

The distribution density of the carbon particles can also be controlled by the processing time when forming the film. For example, when forming the lower layer by an (arc) ion plating method such as a cathode arc method, the distribution density of the carbon particles can be controlled by adjusting the film formation time. As the processing time (film formation time) is prolonged to increase the film thickness, the density of the carbon particles can be higher.

The particle diameter of the carbon particles as referred to in the present description is the maximum length of the carbon particles which is obtained by observing the cross section of the laminate film with a transmission electron microscope (TEM) or a scanning transmission electron microscope (STEM). The distribution density of the carbon particles, like the distribution density of the protrusions, refers to the number of the protrusions recognized in an observation region (10 μm×10 when observing the surface of the laminate film (or the lower layer) with a scanning electron microscope (SEM). When employing an average value, it is calculated as the arithmetic average of five measured values. Unless otherwise stated, the film thickness as referred to in the present description is measured with Calotest available from CSM Instruments SA, but the thickness of the lower layer (hydrogen-free DLC) may preferably be specified from the TEM image of the cross section of the laminate film.

«Upper Layer»

The upper layer which constitutes the laminate layer is composed of B-DLC, and fine protrusions are distributed on the surface side.

(1) B-DLC

When the upper layer as a whole (or the B-DLC as a whole) is 100 atom %, the content of boron (B) in the B-DLC is 1-40 atom % and may be 4-25 atom % in an embodiment and 8-20 atom % in another embodiment. An unduly small amount of B may cause insufficient reduction in the friction of the sliding surface while an unduly large amount of B may make it difficult to form the film.

The B-DLC may further contain 5-25% of H in an embodiment, 8-20% of H in another embodiment, and 10-15% of H in still another embodiment. When the B-DLC contains H, the friction coefficient of the sliding surface can readily be reduced. Note, however, that an unduly large amount of H may soften the B-DLC to lead to fast wear. The B-DLC may preferably have hardness of 15-35 GPa in an embodiment and 18-27 GPa in another embodiment as measured by a nanoindenter. The B-DLC may preferably have a thickness of 0.2-3 μm in an embodiment and 0.5-2 μm in another embodiment. As previously described, the B-DLC may contain modifying elements. The B content and the film thickness are specified by the previously-described methods.

(2) Protrusions

The protrusions are formed by coating the carbon particles on the lower layer side with the B-DLC. In other words, the protrusions are formed along the lines of the carbon particles. Thus, depending on the particle diameter of the carbon particles and the thickness of the B-DLC, the particle diameter and distribution density of the protrusions are almost the same as those of the carbon particles.

That is, the particle diameter of the protrusions is, for example, 0.1-10 μm in an embodiment, 0.5-5 μm in another embodiment, and 1-4 μm in still another embodiment. With regard to the distribution density, the protrusions having a particle diameter of 0.5-5 μm may preferably exist with a density of 20 protrusions/100 $\mu m^2$ or more in an embodiment, 25 protrusions/100 $\mu m^2$ or more in another embodiment, and 30 protrusions/100 $\mu m^2$ or more in still another embodiment. The upper limit is not particularly defined, but suffice it to say that the upper limit may be 100 protrusions/100 $\mu m^2$ or less in an embodiment and 50 protrusions/100 $\mu m^2$ or less in another embodiment.

Unlike the particle diameter of the carbon particles, however, the particle diameter of the protrusions is specified on the basis of the SEM image when observing the surface of the upper layer (laminate film), as in the case of specifying the distribution density. Specifically, for the protrusions having boundaries recognized in the SEM image, the maximum length is employed as the particle diameter.

«Base Material»

The base material of the sliding member to be coated with the laminate film (lower layer) is not limited in its material, but may ordinarily be composed of a metal material, particularly a steel (carbon steel or alloy steel) material. Surface treatment such as nitriding or carburizing may be performed for the base material surface as appropriate. The surface roughness is not limited, but for example, the arithmetic average roughness (Ra) obtained by measurement with an optical interference type surface profiler may preferably be 0.04-0.2 μm in an embodiment and 0.06-0.12 μm in another embodiment. To improve the interfacial adhesion with the lower layer, one or more intermediate layers composed of Cr, CrC, or the like may be formed on the base material surface.

«Film Formation»

The B-DLC and the hydrogen-free DLC which constitute the laminate film can be formed by various methods. For example, the film formation can be carried out using a physical vapor deposition (PVD) method such as a sputtering (SP) method (in particular, an unbalanced magnetron sputtering (UBMS) method) or an arc ion plating (AIP) method.

The B-DLC may be formed, for example, by the SP method. The SP method is a method in which a voltage is applied between a target on the cathode side and a surface to be coated on the anode side, and ions of inert gas atoms (such as Ar) generated due to glow discharge are made to collide with the target surface so that particles (atoms/ molecules) released from the target are deposited to form a film on the surface to be coated. Examples of the target to be used include pure boron and $B_4C$. The released atoms (ions) of B or the like are reacted with a hydrocarbon gas (such as $C_2H_2$ gas) introduced, thereby to form the B-DLC.

The hydrogen-free DLC may be formed, for example, by the AIP method. The AIP method is a method (cathode arc method) in which a target (vaporization source) is used as the cathode to cause arc discharge, for example, in a reactive gas (process gas) so that ions generated from the target react with the reactive gas particles to form a dense film on a surface to be coated to which a bias voltage (negative voltage) is applied. Examples of the reactive gas to be used include hydrocarbon gases such as methane ($CH_4$), acetylene ($C_2H_2$), and benzene ($C_6H_6$).

When carrying out the AIP method, electrically neutral droplets generated at the arc spot are released. These droplets adhere to the surface to be coated (base material surface) to form fine particles (macroparticles), which can be the carbon particles as referred to in the present invention. The present invention is innovative in positively utilizing the droplets and fine particles, which have been heretofore considered to be suppressed or eliminated, as the carbon particles.

«Lubricant Oil»

Various types of lubricant oils can be utilized as the lubricant oil. The lubricant oil may be, for example, an engine oil or may also be an automatic transmission fluid (ATF), a continuously variable transmission fluid (CVTF), or the like.

Figure 28:
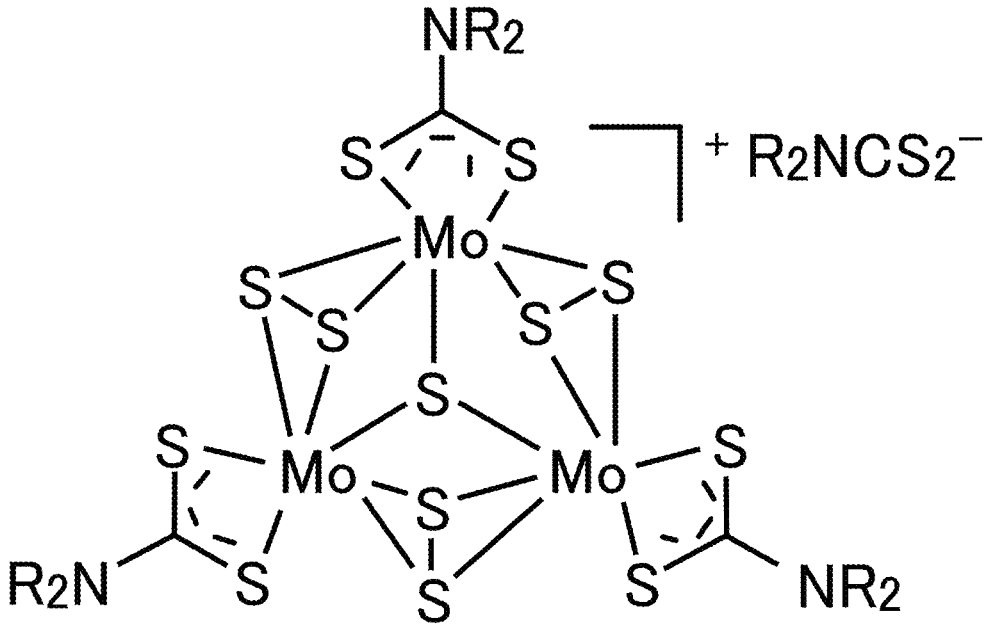
FIG. 28 is a molecular structure diagram illustrating an example of the Mo-trinuclear.

The lubricant oil may preferably contain, for example, an oil-soluble molybdenum compound that has a chemical structure comprising a trinuclear of Mo. The Mo-trinuclear can act preferentially on the B-DLC to contribute to smoothing and reduction in friction of the sliding contact surface. For example, the Mo-trinuclear may preferably be composed of $Mo_3S_7$ or $Mo_3S_8$, among which $Mo_3S_7$ may be particularly preferred. The Mo-trinuclear as referred to in the present description is not limited in its functional groups bonded to the ends, molecular weight, and other properties, provided that the Mo-trinuclear comprises a skeleton (molecular structure) composed of a trinuclear. For reference, an example of the molybdenum sulfide compound composed of $Mo_3S_7$ is illustrated in FIG. 28. In FIG. 28, R represents a hydrocarbyl group.

The Mo-trinuclear may preferably be contained, for example, at a mass ratio of Mo to the lubricant oil as a whole of 200-1000 ppm in an embodiment, 300-800 ppm in another embodiment, and 400-700 ppm in still another embodiment. An unduly small amount of the Mo-trinuclear may make it difficult to exhibit the effect of containing the Mo-trinuclear. An unduly large amount of the Mo-trinuclear may cause the B-DLC to readily wear. When the mass ratio of Mo to the lubricant oil as a whole is represented in ppm, it will be denoted by "ppmMo."

The ATF and CVTF (both of which will be collectively referred to as a "fluid" in a simple term) need to ensure a certain friction coefficient between the pressure contact surfaces which transmit the drive power. On the other hand, the fluid is not exposed to the combustion gas and is less likely to be used in a high-temperature range. Accordingly, the fluid and the engine oil are different in the following points.

The fluid is usually free from extreme pressure agents and antiwear agents, such as molybdenum dithiocarbamate (MoDTC) and zinc dialkyl dithiophosphate (ZnDTP), in many cases. The fluid before adding the Mo-trinuclear therefore usually contain 50 ppm or less of Mo and 50 ppm or less of Zn. The fluid may contain about 500-1300 ppm of S and about 100-500 ppm of P in many cases. The fluid may contain 1000 ppm or less of Ca and 50 ppm or less of Na in many cases because it is not necessary for the fluid to contain a large amount of detergent dispersant (such as basic Ca sulfonate).

«Use Application»

Specific form and use application of the sliding member of the present invention are not limited, and the sliding member of the present invention can be used for a wide variety of sliding machines. Examples of the sliding members include shafts and bearings; gears that are geared with each other; and cams and valve lifters that constitute a dynamic valve system. Examples of the sliding machines include driving units, such as transmissions and engines, and oil pumps incorporated in the driving units.

The oil pump (sliding machine) which pumps a lubricant oil may be, for example, an internal gear pump or a vane pump. In the case of an internal gear pump, the laminate film of the present invention may preferably be formed on at least one of the internal tooth surface (sliding surface) of the outer rotor (slide member) or the external tooth surface (slide surface) of the inner rotor (slide member).

In the case of a vane pump, the laminate film of the present invention may preferably be formed on at least one of the inner peripheral surface (sliding surface) of the cam ring (sliding member) or the tip end surface (sliding surface) of the vane (sliding member). As will be understood, it may be sufficient to form the laminate film on only one of the sliding surfaces facing each other because the laminate film also act to smoothen the counterpart sliding surface.

For example, a cam ring composed of an iron-based sintered material can be smoothened relatively early by being in sliding contact with the tip end surface of a vane coated with the laminate film even when the surface roughness of the inner peripheral surface is large before sliding (before the pump operation). During this operation, the sliding surface (upper layer surface) composed of the laminate film is also smoothened at the same time. Thus, the vane pump including the vane coated with the laminate film of the present invention at the tip end face can be drastically reduced in the friction loss torque.

EXAMPLES

1 Overview

In mechanical units such as transmissions, oil pumps are provided for oil lubrication and hydraulic pressure generation. An oil pump has sliding parts that slide relative to each other, and the friction loss occurs there. To improve the mechanical efficiency of the pump, it is necessary to reduce this friction loss.

Figure 2:
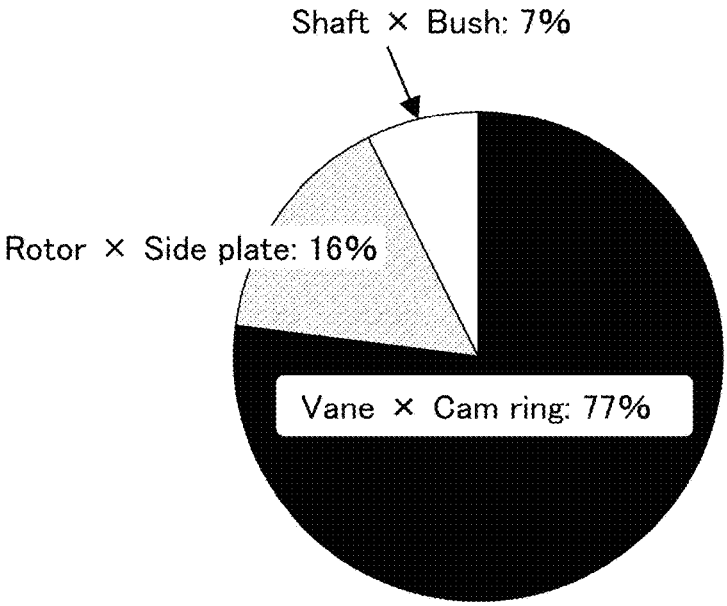
FIG. 2 is a circular graph illustrating details of the friction losses of a vane oil pump.

FIG. 1 illustrates the structure of a vane oil pump as an example of an oil pump. In this scheme, friction occurs between the vane and the cam ring, between the rotor and the side plate, and between the shaft and the bush. FIG. 2 illustrates details of the friction losses of respective parts (a rotation speed of 1200 rpm, a main oil pressure of 0.8 MPa, and an oil temperature of 80° C.). In the vane oil pump, the ratio of the friction loss between the vane and the cam ring is as large as about 80%, and it can be said that reducing the friction of this portion is particularly effective in increasing the efficiency of the pump. The vane and the cam ring are in a sliding state in which the sliding friction of the high surface pressure primarily occurs around a specific part such as the oil suction part, and the lubricating state is considered to be in a boundary lubrication state to a mixed lubrication state.

In the present examples, attention was paid to the boron-containing DLC film (abbreviated as a "B-DLC film"), and the film composition and structure suitable for achieving both the low friction and the high wear resistance under sliding conditions of the oil pump were studied. In addition, the content of oil additives (in particular, Mo-trinuclear) suitable for achieving both the reduced friction coefficient (μ) and the wear suppression of the previously-described B-DLC film with respect to oil was specified. It has been found that, using them, both the low-friction properties and the wear resistance of the surface of the oil pump sliding part can be satisfied at the same time and further the surface roughness of the sliding surface can be reduced by improving the conformability at an early stage of sliding. As a result, in the sliding state of the vane in the mixed lubrication, the ratio of the boundary friction (i.e. the solid contact) was able to be reduced and further friction reduction between the vane and the cam ring was realized. The details are as follows.

2 Test Method 2.1 Oil Pump Test Piece

Figure 3:
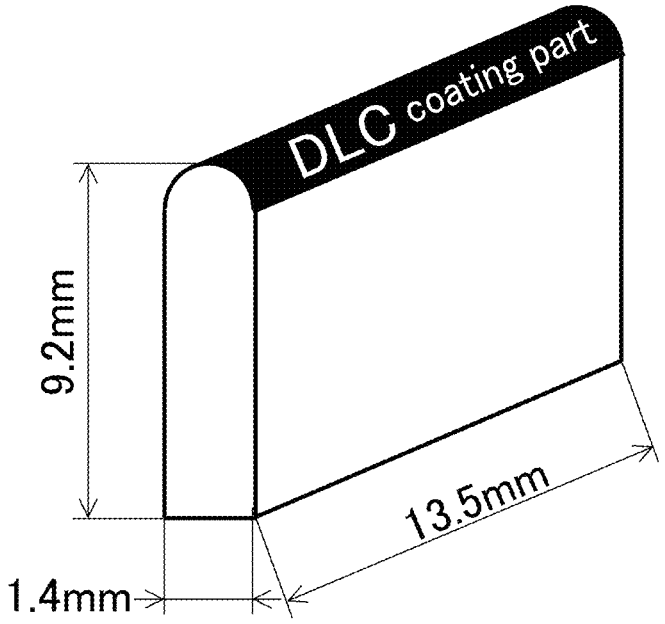
FIG. 3 is a perspective view illustrating a vane (material under test) of a vane oil pump.

FIG. 3 illustrates the vane shape of a vane oil pump used for evaluation. The vicinity of the tip end top part having the cross section of an approximately circular arc shape (semi-cylindrical shape) serves as a contact surface with the counterpart cam ring. The tip end top part was coated with each of various DLC films. The material of the vane is high-speed tool steel. The tip end top part of a normal vane (non-treated) as a reference is composed of a grinding processed surface. The film formation process for the DLC films was performed after reducing the surface roughness by performing a mirror polishing process. Types of the DLC films used for evaluation will be described in Section 2.2. The counterpart cam ring is an iron-based sintered material and its surface is coated with a phosphate film. The surface roughness of the vane and cam ring will be described in Section 2.3.1.

2.2 Film Formation Process for DLC 2.2.1 Cross-Sectional Structure of Films

Table 1 lists the types of DLC films prepared in the present examples. FIG. 4 illustrates schematic diagrams of the cross-sectional structures of these DLC films.

The laminate film containing a large amount of fine particles (fine-particle-rich laminate film) illustrated in FIG. 4-1 was formed as follows. First, the steel base material was coated with Cr of a thickness of about 100 nm as a metal intermediate layer. Thereafter, the metal intermediate layer was coated with high-hardness hydrogen-free DLC (ta-C coating available from Hauzer) containing a large amount of fine particles with a particle diameter of 0.5 μm or more and having a film thickness of 1.3 μm (as a lower layer) by the arc ion plating method. Further, the hydrogen-free DLC was coated with B-DLC containing boron and having a film thickness of 1.1 μm (as an upper layer) by the sputtering method. Thus, the fine-particle-rich laminate film having a laminate structure was obtained.

The film formation temperature was set to 200° C. or lower for both the upper layer and the lower layer. The hydrogen-free DLC coating as the lower layer is an amorphous carbon film composed of carbon and hydrogen, which is a high-hardness DLC having hardness of 59 GPa as measured by a nanoindenter.

The B-DLC coating as the upper layer comprises a nano-multilayer structure layer in which B-DLC that is an amorphous carbon film composed of carbon, hydrogen, and boron (boron content is 12-17 atom %) and DLC that is an amorphous carbon film composed only of carbon and hydrogen are alternately laminated to have respective film thicknesses of about 100 nm.

As will be described in the next section, the B-DLC film formed by the sputtering method as the upper layer to be the outermost surface does not have a particle-like shape on the surface as the film in itself. However, the DLC film containing fine particles is coated with the B-DLC, which is thereby formed in a shape that follows the surface shapes of the fine particles. This allows fine-particle-like protrusion parts to appear on the outermost surface of the laminate film.

It can be considered that the fine-particle-like protrusion parts act as abrasive materials and have abrasive properties for the counterpart sliding material. On the other hand, the protrusion parts have a high actual contact surface pressure with the counterpart material, and the wear readily progresses from the protrusion parts. It can also be considered that when the B-DLC film as the upper layer has a film structure that is more likely to wear as compared with the hydrogen-free DLC film, the protrusion parts will wear away at an early stage and will not cause excessive wear of the counterpart material. Furthermore, when the protrusion parts of the B-DLC on the outermost surface side become worn, the high-hardness fine-particle protrusions of the lower layer are exposed on the surface and support a part of the vertical load. As a result, the wear progression of the B-DLC film on the surface side appears to be suppressed.

For comparison, a laminate film containing a small amount of fine particles (fine-particle-poor laminate film) as illustrated in FIG. 4-2 was also produced by way of trial through the same film formation method as that for the fine-particle-rich laminate film. The arc ion plating method for forming the lower layer was adjusted to reduce the film thickness of the high-hardness hydrogen-free DLC to 0.8 μm thereby to reduce the content of the fine particles. The B-DLC as used herein was a uniform film consisting only of a B-DLC film rather than the previously-described nano-multilayer structure film.

For further comparison, as illustrated in FIG. 4-3, a single-layer B-DLC film (film thickness: 3 μm) obtained by the sputtering method of coating the Cr intermediate layer only with B-DLC and a single-layer hydrogen-free DLC film (film thickness: 1 μm, nanoindenter hardness: 58 GPa) obtained by the arc ion plating method of coating the Cr intermediate layer with a high-hardness hydrogen-free DLC (Geniuscoat HA available from Nippon ITF Inc.) were also produced by way of trial and used for evaluation. The single-layer hydrogen-free DLC film was polished after the film formation of the hydrogen-free DLC. Each of these DLC films was applied to the tip end top part of a vane (high-speed tool steel) of the vane pump and the surface of a block test piece (SUS440C) and subjected to the block-on-ring friction test, which will be described later.

2.2.2 Particle-Like Protrusions on Outermost Surface

FIG. 5 illustrates SEM images of the surfaces of various DLC films applied to the vanes. As shown in FIG. 5-1 and FIG. 5-2, it can be found that fine-particle-like protrusions exist on the surfaces of the laminate B-DLC films. In particular, it can be seen that a larger number of protrusions exist on the fine-particle-rich laminate B-DLC film (FIG. 5-1) than on the fine-particle-poor laminate B-DLC film (FIG. 5-2). On the other hand, almost no fine-particle-like protrusions were observed on each of the surfaces of the single-layer B-DLC film (FIG. 5-3) and the single-layer hydrogen-free DLC film (FIG. 5-4).

Figure 6:
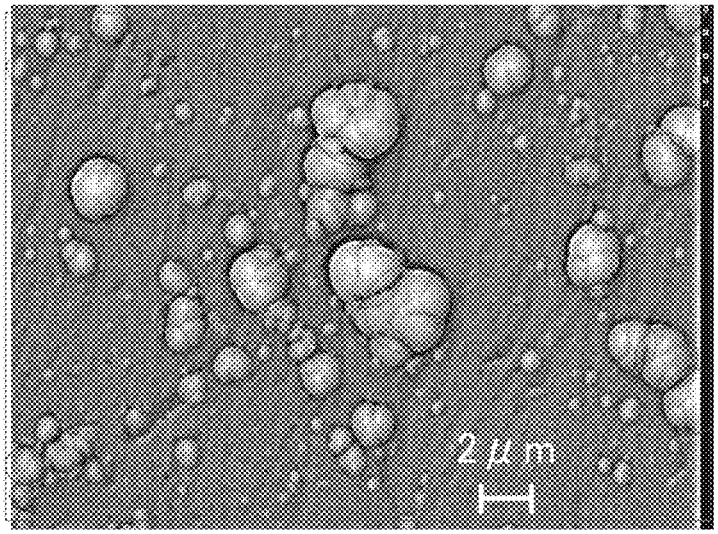
FIG. 6 is a view showing a measurement example of protrusions based on the SEM image.
Figure 7:
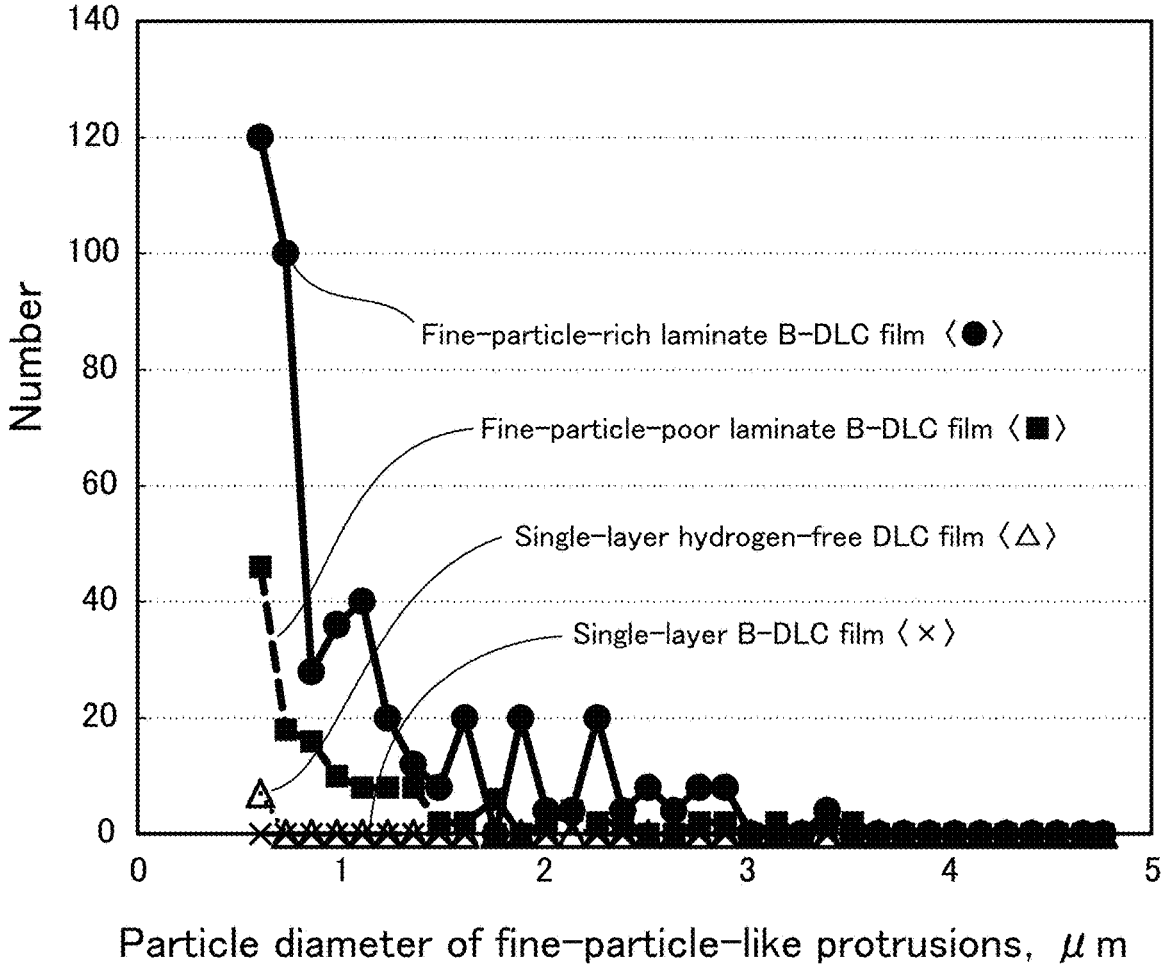
FIG. 7 is a graph illustrating the particle diameter distributions of the protrusions.

On the basis of a SEM image when observing the surface of each DLC film as shown in the measurement example of FIG. 6, the diameter and the number of protrusions were measured for those having a particle diameter of 0.5 μm or more. These were used to obtain the particle diameter distribution, the average particle diameter, and the number per unit area of protrusions existing on each surface. FIG. 7 illustrates the measured data of the particle diameter distribution and Table 2 lists the quantitative data thereof.

From FIG. 7 and Table 2, it can be found that a large number of fine-particle-like protrusions having a diameter of 0.5-5 μm exist in the laminate films. The surface of the fine-particle-rich laminate B-DLC film was formed with fine-particle-like protrusions having a particle diameter of 0.5-5 μm and existing with a density of 38 protrusions/100 $\mu m^2$, protrusions having a particle diameter of 1-5 μm and existing with a density of 15 protrusions/100 $\mu m^2$, and protrusions having a particle diameter of 2-5 μm and existing with a density of 4.8 protrusions/100 $\mu m^2$.

The surface of the fine-particle-poor laminate B-DLC film was formed with protrusions having a particle diameter of 0.5-5 μm and existing with a density of 12 protrusions/100 $\mu m^2$, protrusions having a particle diameter of 1-5 μm and existing with a density of 4 protrusions/100 $\mu m^2$, and protrusions having a particle diameter of 2-5 μm and existing with a density of 1.5 protrusions/100 $\mu m^2$. The single-layer B-DLC and the hydrogen-free DLC were each formed with protrusions having a particle diameter of 0.5-5 μm or 1-5 μm and existing with a density of 1 protrusion/100 $\mu m^2$ or less and protrusions having a particle diameter of 2-5 μm and existing with a density of 1.0 protrusions/100 $\mu m^2$ or less.

2.2.3 Film Composition and Hardness of DLC Films

FIG. 8 illustrates results of quantitatively determining the composition distribution in the depth direction of each of the fine-particle-rich laminate B-DLC film and the fine-particle-poor laminate B-DLC film (both of which are collectively referred to as a "fine-particle-containing laminate B-DLC film") by Auger electron spectroscopy (AES). The depth-direction distribution was analyzed by sputtering under the application of the Zalar rotation method. The sputtering depth was converted by the sputtering rate of $SiO_2$.

With regard to the fine-particle-rich laminate B-DLC film illustrated in FIG. 8-1, the amount of boron (B) and carbon (C) varies within a range of 3-17 atom % in the upper layer having a sputtering depth of about 0-1100 nm and it can thus be found that the fine-particle-rich laminate B-DLC film has a nano-multilayer structure as described in Section 2.2.1. In the lower layer having a depth of 1100-2400 nm, only carbon (C) is detected and it can be found that the lower layer is a DLC film. It can also be found that the Cr coating as the intermediate layer exists below the lower layer.

With regard to the fine-particle-poor laminate B-DLC film illustrated in FIG. 8-2, the boron (B) stably exists at about 17 atom % in the upper layer having a sputtering depth of about 0-1000 nm and it can thus be found that the fine-particle-poor laminate B-DLC film is a uniform film of B-DLC as described in Section 2.2.1. In the lower layer having a depth of 1000-1800 nm, only carbon (C) is detected and it can be found that the lower layer is a DLC film. It can also be found that the Cr coating as the intermediate layer exists below the lower layer.

The composition of a DLC film was specified as follows. The amount of hydrogen was quantitatively determined by the Rutherford backscattering analysis (RBS)/hydrogen forward scattering analysis (HFS) method. The amount of boron and the amount of carbon were quantitatively determined by analysis using an electron probe microanalyzer (EPMA). Table 3 collectively lists the film compositions thus determined. The quantitative accuracy of 2 atom % or less cannot be ensured for the hydrogen content; therefore, when the hydrogen content is 2 atom % or less, it is expressed simply as 2 atom % or less.

The hardness of each film as measured by a nanoindenter is also listed in Table 3. The lower layers of the fine-particle-containing laminate B-DLC films and the single-layer hydrogen-free DLC film had a hydrogen content of 2 atom % or less and were all hard films having hardness of 58 GPa or more.

2.2.4 Features of Fine Particles Contained in Fine-Particle-Containing Laminate B-DLC Films A block test piece coated with the fine-particle-rich laminate B-DLC film was sliced by an FIB method (μ-sampling method) and observed using a scanning transmission electron microscope (STEM, JEM-ARM200F available from JEOL Ltd). TEM images of the film cross section are shown in FIG. 9. FIG. 9-1 shows a site in which fine-particle-like protrusions having a diameter of about 2 μm exist on the surface of the laminate film while FIG. 9-2 shows a site in which fine-particle-like protrusions having a diameter of about 0.5 μm or less exist. From both the TEM images, it can be confirmed that the fine particles exist in the vicinity of the upper part of the hydrogen-free DLC of the lower layer while the B-DLC film coating having a nano-multilayer structure (with a stripe-like contrast in the horizontal direction in the TEM images) is formed as the upper layer in a shape of following the surface shapes of the particles.

The structure of the fine particles (carbon particles) contained in the lower layer DLC part of the fine-particle-containing laminate B-DLC film was analyzed by Raman analysis. First, a test piece was prepared in which the block test piece (SUS440C) was coated only with the lower layer of the fine-particle-containing laminate B-DLC film. Then, for three locations of DLC film parts (fine particle absence part) and three locations of fine particle parts on the surface of the test piece, spectral measurement was performed using an microscopic laser Raman spectroscope (NRS-3300 available from JASCO Corporation) with an objective lens of 100 magnifications, an excitation laser wavelength of 532 nm, a slit of 0.05 mm φ, exposure of 100 s, and laser intensity of 0.1 mW.

Figure 10:
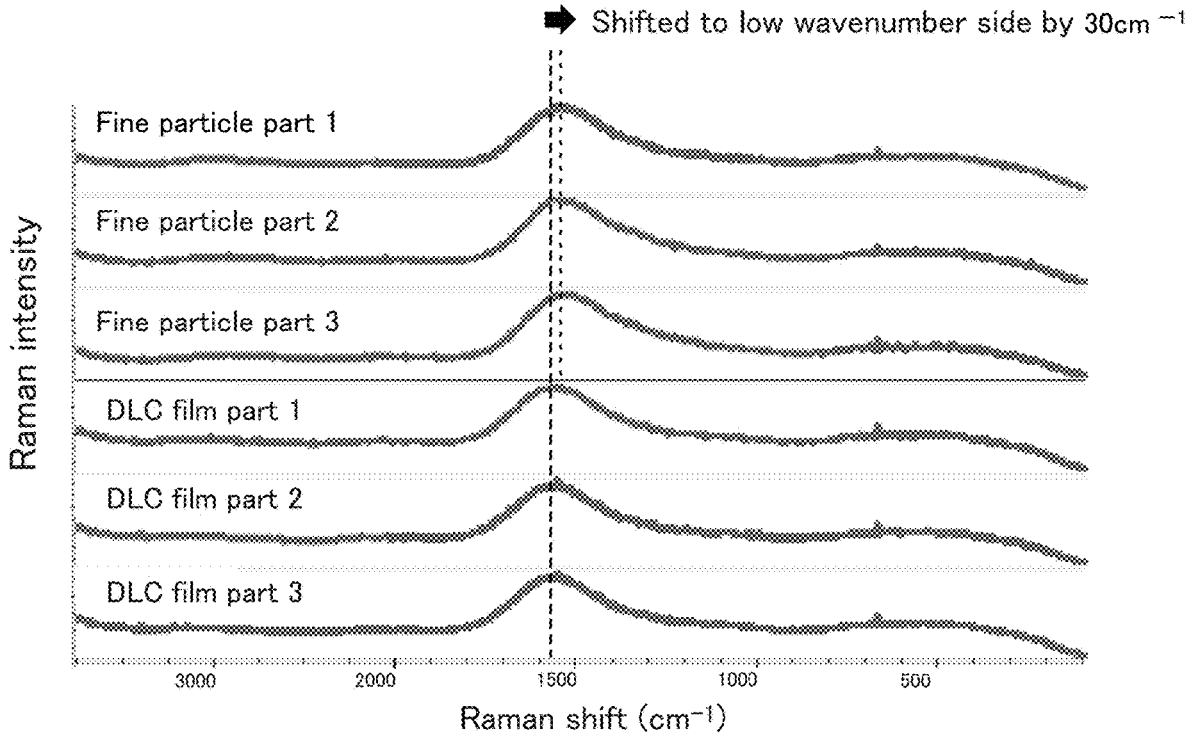
FIG. 10 illustrates Raman spectra of the lower layer of the fine-particle-rich laminate B-DLC film.

FIG. 10 illustrates the Raman spectra. In each of the three locations for measurement of the DLC film parts, the peak of the G band spectrum appears at 1566 $cm^{-1}$. On the other hand, the peaks of the fine particle parts appear at 1532 $cm^{-1}$ and it can be found that the peaks shift to the lower wavenumber side by about 30 $cm^{-1}$ with respect to those of the DLC film parts. That is, it can be determined that the fine particle parts have a carbon-carbon bond structure different from that of the DLC film parts.

FIG. 11 shows electron beam diffraction patterns of the fine particle parts and DLC film part of the fine-particle-rich laminate B-DLC film. Unlike the hydrogen-free DLC film part (FIG. 11-3), a bright spot is observed in the diffraction pattern (FIG. 11-1) of the fine particle part having a diameter (Φ) of about 2 μm, and it can be considered that the fine particle part has a crystal structure.

On the other hand, like the hydrogen-free DLC film part (FIG. 11-3), a diffraction pattern exhibiting an amorphous structure is observed in the fine particle part having a diameter Φ of about 0.5 μm (FIG. 11-2). That is, it can be considered that relatively large particles of a particle diameter Φ of about 2 μm have a crystal structure while small particles of a particle diameter Φ of 0.5 μm or less are in an amorphous structure similar to the DLC film.

Table 4 collectively lists the ratio of π bonds ($sp^2$ bonds) and σ bonds ($sp^a$ bonds) of carbon obtained by electron energy loss spectroscopy (EELS) for each of the above sites. The ratio π*/(π*+σ*) of the fine particle part having a diameter Φ of about 2 μm of FIG. 9-1(A) is about 0.111, which is larger than 0.041 of the hydrogen-free DLC film part of FIG. 9-2(C). It can therefore be determined that the number of π* bonds is larger in the fine particle part having a diameter Φ of about 2 μm than that in the hydrogen-free DLC film. However, this value is smaller than those of DLC and graphite (HOPG) formed by the sputtering method, and it can be determined that the $sp^2$ bond ratio of the fine particle part is smaller than those of DLC and graphite (HOPG) formed by the sputtering method.

The ratio π*/(π+σ*) of the fine particle part having a diameter Φ of about 0.5 μm illustrated in FIG. 9-2(B) is about 0.054, which is smaller than that of the fine particle part having a diameter Φ of about 2 μm, but is slightly larger than that in the hydrogen-free DLC film part of FIG. 9-2(C). It can thus be determined that the number of π* bonds in the fine particle part having a diameter Φ of about 0.5 μm is larger than that in the hydrogen-free DLC film.

From the above results, it can be said that the fine particles contained in the fine-particle-rich laminate B-DLC film of the present example have a value of π*/(π+σ*) within a range of 0.05-0.12 and thus have a feature that the number of π bonds is larger than that in the hydrogen-free DLC film (reference material: "Verification of crystal structure evaluation scheme for DLC films by EELS, XPS, and RAMAN").

2.3 Initial Surface Roughness of Test Pieces Under Test 2.3.1 Surface Roughness of Vane and Cam Ring of Oil Pump The surface roughness profiles of vanes and a cam ring subjected to a vane oil pump test described later were measured using an optical interference type surface profiler (NewView 5022 available from Zygo Corporation). Table 5 is a list of the surface roughness (referred to as "optically measured roughness") obtained by this measurement.

Table 5 additionally lists the measured values by a stylus type surface roughness tester (also referred to as "stylus type measured roughness") as reference values. Absolute values of the roughness differ depending on the measurement method and the measurement region, so the optically measured roughness and the stylus type measured roughness are different, but the general tendency of roughness is in good agreement. Hereinafter, arithmetic average roughness (Ra) is based on the optically measured roughness unless otherwise stated.

FIG. 12 and FIG. 13 illustrate the results of measuring the surface roughness profiles of various vanes and a cam ring before the test using the optical interference type surface profiler. As additionally stated in these figures, measurement of the roughness of the vanes was performed for an enlarged region of the lateral direction (X-axis) 176 μm×the longitudinal direction (Y-axis) 132 μm in the vicinity of the central part of the vane tip end serving as the primary sliding part with the counterpart cam ring. More specifically, the measurement was performed by extracting five two-dimensional roughness profiles in the X-axis direction from that region at positions in which the Y axis was changed. The average value of the measured values was employed as the surface roughness. When calculating the roughness profiles, a high-pass filter process with a cutoff value of 0.08 mm was applied in order to remove the curvature shapes of the vane tip end R.

Measurement of the roughness of the cam ring was carried out in the same way as for the vanes. However, the measurement region was set to a region of the lateral direction (X-axis) 132 μm×the longitudinal direction (Y-axis) 132 μm. The number of measurement points for obtaining the average value: 5 and the cutoff value of the high-pass filter: 0.08 mm were the same as those for the vanes.

The initial surface roughness of cam rings was assumed to be the same because a new cam ring was used in any test using the counterpart vane.

The initial surface roughness of vanes of a reference steel material used for normal vane pumps is 0.09 μm. In contrast, the surface roughness of the mirror-polished steel material is reduced to 0.02 μm. As previously described, the processes of forming various DLC films were performed on the mirror-polished products (base materials).

It can be found from FIG. 12 that the surface roughness of the fine-particle-rich laminate B-DLC film among the DLC films is particularly large. As illustrated in FIG. 13, the roughness of the initial surface of the cam ring is 0.54 μm, which is significantly larger than those of the vanes of 0.02-0.09 μm. This is due to the phosphate treatment applied to the surface and the fine vacancy recesses existing in the iron-based sintered material.

2.3.2 Initial Surface Roughness of Block-On-Ring Test Pieces

To study the influence of combinations of various DLC films and oils on the friction coefficient, a block-on-ring friction test was conducted. In this test, the same carburized steel materials were used as the ring test pieces. For the block test pieces, test pieces composed of reference steel materials and test pieces coated with various DLC films were used. Table 6 collectively lists the surface roughness of the block test pieces before the friction test. The order of the surface roughness listed in Table 6 is approximately the same as the previously-described surface roughness of the vanes. However, as for the block test pieces, mirror-polished steel materials are used for the base materials treated with the DLC films and the reference steel material. For this reason, the absolute values of the surface roughness are smaller than the surface roughness of the previously-described vanes.

2.4 Oils Under Test

A commercially available CVT fluid (referred to as a "commercially available CVTF," hereinafter) and an oil obtained by additionally compounding an additive containing a Mo-trinuclear to the commercially available CVTF as a base oil (the latter will be referred to as a "Mo-trinuclear-containing oil," hereinafter) were prepared. These were subjected to a block-on-ring friction test and an oil pump test, which will be described later. The Mo-trinuclear is that written as "Trinuclear" in the disclosed documentation "Molybdenum Additive Technology for Engine Oil Applications" available from Infineum International Limited. The additive was additionally compounded so that the Mo content would be 100 ppmMo, 300 ppmMo, 500 ppmMo, or 800 ppmMo as the mass ratio to the oil as a whole. It is confirmed that the Mo content in the commercially available CVTF (base oil) is 0 ppmMo when measured by the metal element analysis (S method) and the commercially available CVTF is free from Mo-based additives.

2.5 Block-On-Ring Friction Test

Figure 14:
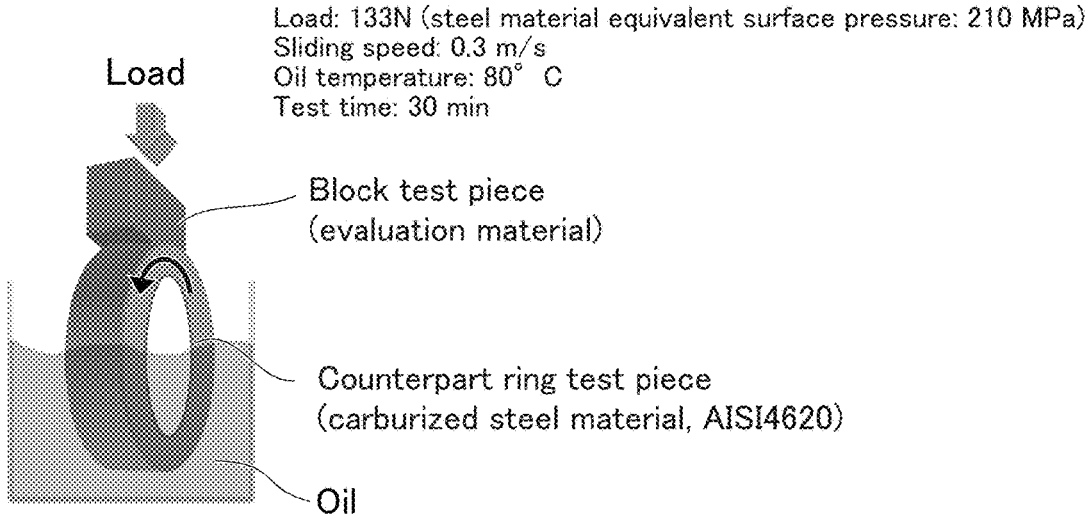
FIG. 14 is an explanatory diagram of a block-on-ring friction test.

Friction coefficients (referred simply to as "μ," hereinafter) when combining various test pieces and various oils were measured by the block-on-ring friction test as illustrated in FIG. 14. The sliding surface width of each block test piece to be an evaluation material was set to 6.3 mm. A standard test piece (S-10 available from FALEX CORPORATION, hardness of HV 800 and surface roughness Ra of 0.26 μm) composed of a carburized steel material (A1514620) and having an outer diameter of φ35 mm and a width of 8.8 mm was used as the ring test piece to be the counterpart material. The friction test was performed for a test time of 30 minutes under the condition of a test load of 133 N, a sliding speed of 0.3 m/s, and an oil temperature of 80° C. (fixed), and the average value of the friction coefficient (p) for one minute immediately before completion of the test was read. In addition, the wear depth of a block test piece after the test was measured with the previously-described optical interference type surface profiler to evaluate the wear resistance of each evaluation material.

2.6 Oil Pump Test

Each of various vanes to be the evaluation materials and a cam ring composed of an iron-based sintered material (the same in each test) were incorporated in the vane oil pump, as illustrated in FIG. 1, used in the existing CVT, and the friction loss torque was measured while circulating the oil by a motoring method. The test condition was as follows: a rotational speed of 1000 rpm, a hydraulic pressure of 1 MPa, an oil temperature of 80° C. (fixed), and a test time of 5 hours.

Figure 15:
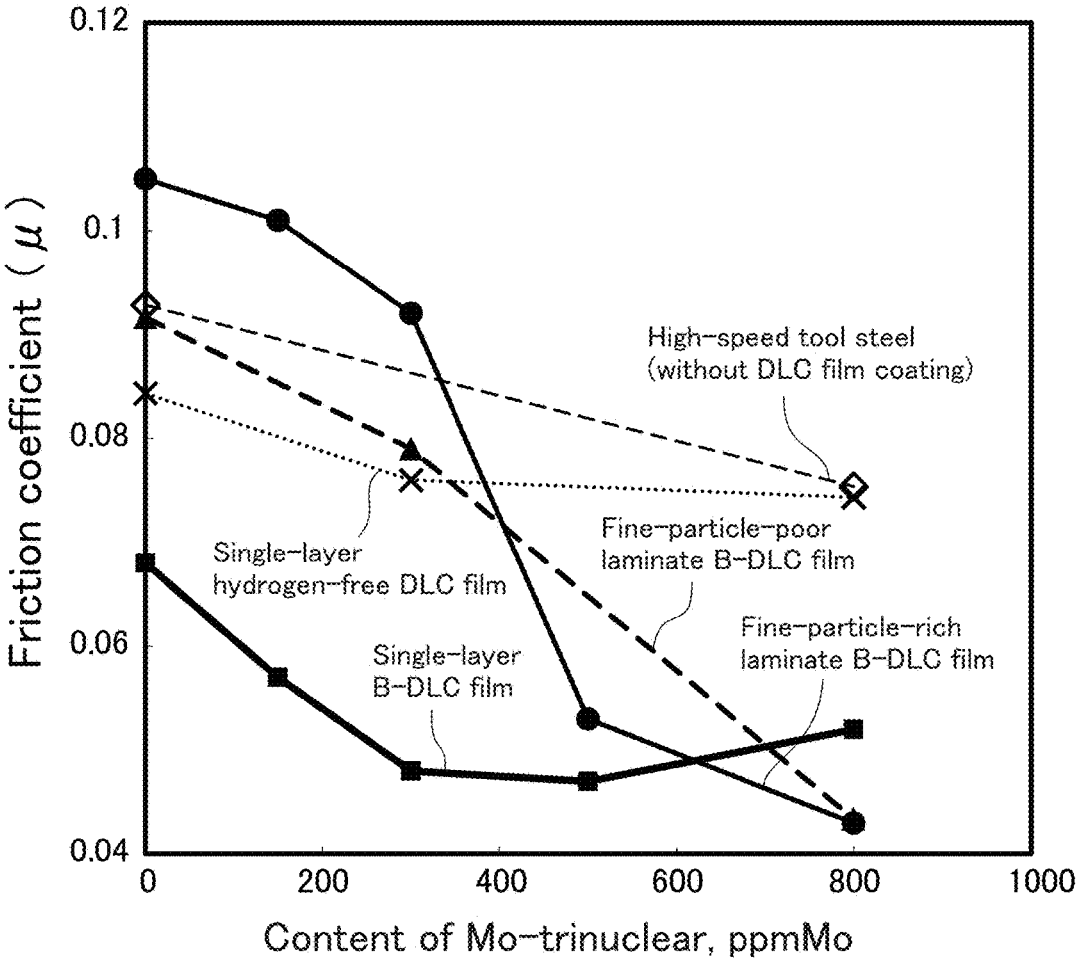
FIG. 15 is a graph illustrating the relationship between the Mo-trinuclear content and the friction coefficient.

3.1 Evaluation of Friction Coefficient/Wear Properties in Block-On-Ring Friction Test (1) Friction Coefficient FIG. 15 illustrates the friction coefficient (μ) measured by the block-on-ring friction test using oils having different Mo-trinuclear contents and various block test pieces. As described above, the block test piece without the coating of the DLC film is composed of a reference steel material (high-speed tool steel).

In the cases of the reference test piece composed of a high-speed tool steel and the comparative test piece coated with a single-layer hydrogen-free DLC film, even when the Mo-trinuclear content in the oil is increased to 800 ppmMo, μ is about 0.08 and low-friction properties are not obtained.

On the other hand, all of the test piece coated with a fine-particle-rich laminate B-DLC film, the test piece coated with a fine-particle-poor laminate B-DLC film, and the test piece coated with a single layer B-DLC film tend to have small μ as the Mo-trinuclear content in the oil increases (in particular, when the Mo-trinuclear content is 300 ppmMo or more). Excellent low-friction properties of μ of 0.05 or less can be obtained in the fine-particle-rich laminate B-DLC film and in the fine-particle-poor laminate B-DLC film when the Mo-trinuclear content is 500 ppmMo or more and 800 ppmMo or more, respectively.

It has been found that the single-layer B-DLC film exhibits excellent low-friction properties of μ of 0.05 or less when using an oil in which the Mo-trinuclear content is 150 ppmMo or more or when using an oil in which the Mo-trinuclear content is 300 ppmMo or more. That is, it has been found that excellent low-friction properties can be obtained by combining a sliding member coated with B-DLC that contains boron at the outermost surface and an oil that contains a certain amount or more of the Mo-trinuclear.

(2) Wear Depth

Figure 16:
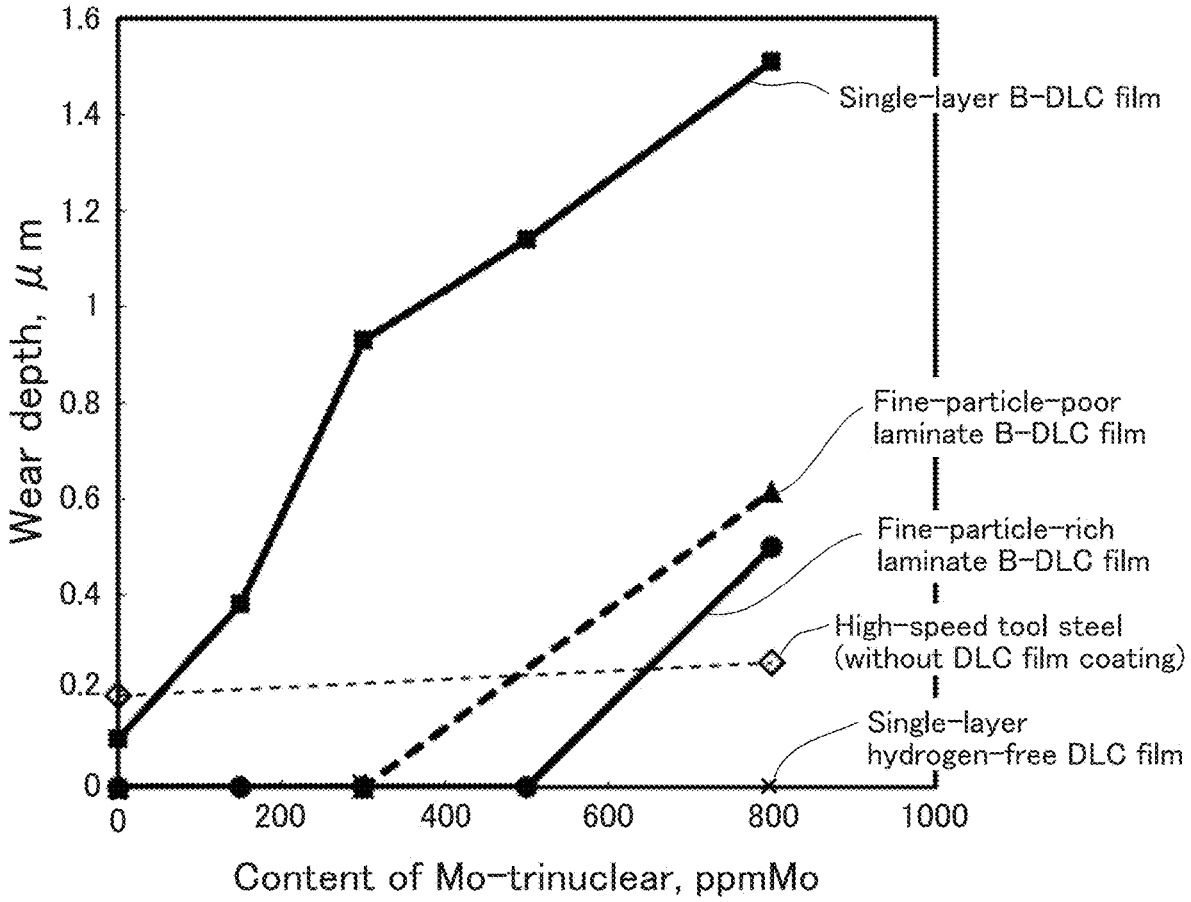
FIG. 16 is a graph illustrating the relationship between the Mo-trinuclear content and the wear depth.

FIG. 16 illustrates the wear depth of the block test pieces after the block-on-ring friction test. Paying attention to each DLC film and Mo-trinuclear-containing oil with which low-friction properties can be obtained, it can be said as follows. Even when the Mo-trinuclear content varies, the wear depth (wear amount) is smaller in the fine-particle-rich laminate B-DLC film and the fine-particle-poor laminate B-DLC film than that in the single-layer B-DLC film.

Specifically, the wear depth of the single-layer B-DLC film increases as the Mo content increases because the Mo-trinuclear content is small. In contrast, the fine-particle-rich laminate B-DLC film and the fine-particle-poor laminate B-DLC film exhibit good wear resistance to such an extent that the wear depth is not recognized, when the Mo-trinuclear content is 500 ppmMo or less or 300 ppmMo or less. It has thus been found that not only the friction is reduced but also the wear resistance can be improved by the laminate structure of the film.

In both of the fine-particle-rich laminate B-DLC film and the fine-particle-poor laminate B-DLC film, the wear depth is 0.6 μm or less even when the Mo-trinuclear content is 800 ppmMo, and the upper layer (B-DLC film layer) of the laminate film remains.

Despite the same composition and film structure of the B-DLC film itself, the upper layer of the fine-particle-rich laminate B-DLC film and the single-layer B-DLC film have different wear resistance. The reason of this can be considered as follows. When the surface of the fine-particle-rich laminate B-DLC film wears, hard fine particles in which the σ bond ratio is higher than that in the B-DLC film formed inside the film appear on the surface. It is considered that such fine particles support a large part of the vertical load at the sliding part and suppress the progression of wear. It is estimated that the fine particles having a high σ bond ratio exhibit excellent wear resistance, also from the fact that the single-layer hydrogen-free DLC film likewise having a high σ bond ratio exhibits excellent wear resistance within the same range of the Mo-trinuclear content (800 ppmMo or less). As previously described, however, desired low-friction properties cannot be obtained in the single-layer hydrogen-free DLC film.

3.2 Measurement Results of Friction Loss in Oil Pump Test

Figure 17:
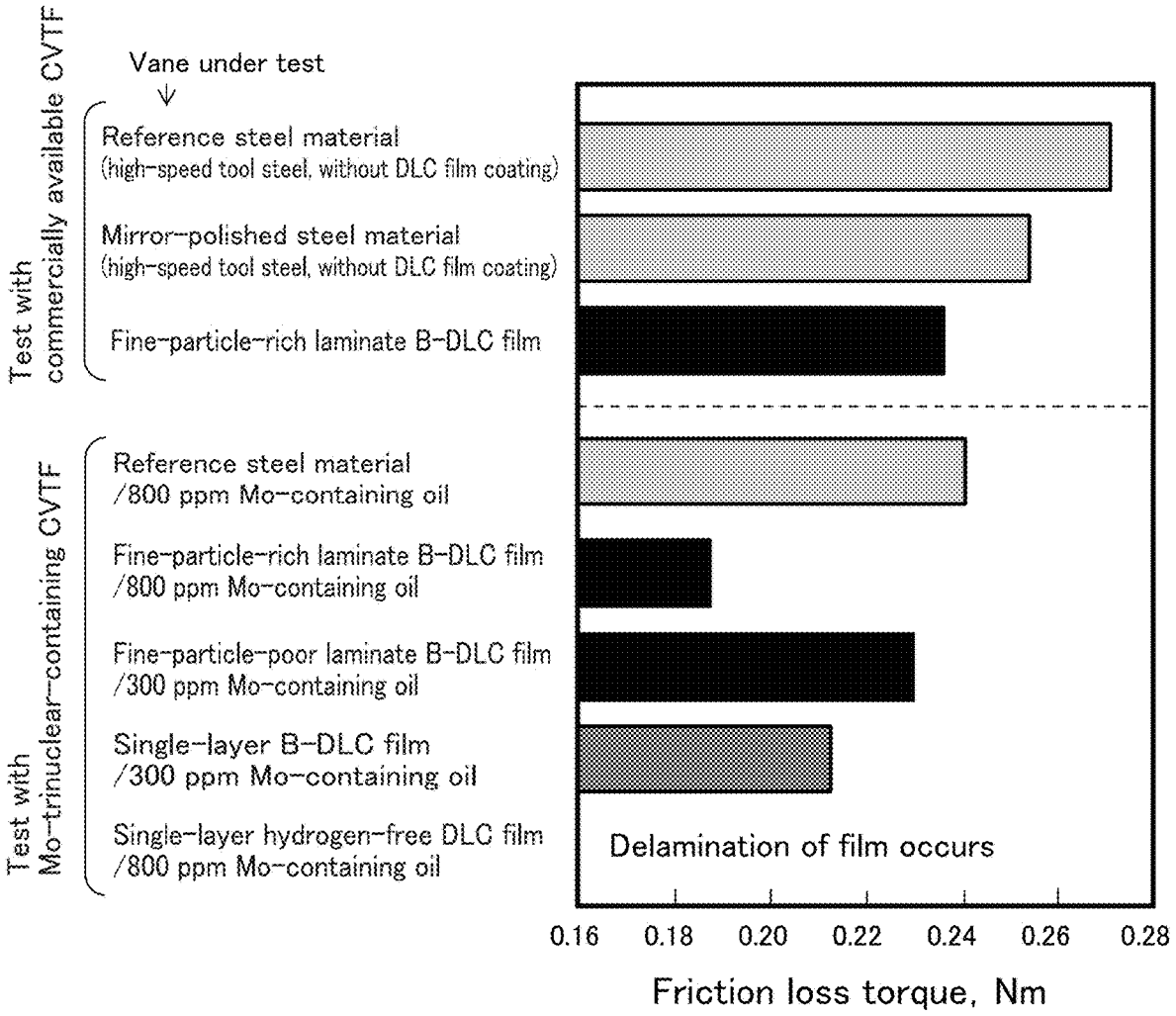
FIG. 17 is a bar graph comparing the friction loss torques of oil pumps.

Using an oil pump assembled with each of various vanes as the evaluation materials and a commercially available CVTF or a Mo-trinuclear-containing oil, the friction loss torque of the oil pump was measured. The results are listed in FIG. 17.

When the commercially available CVTF was used, the friction loss torque was reduced by 13% (0.27 N·m→0.24 N·m) by using the vane coated with the fine-particle-rich laminate B-DLC film rather than using the vane of the reference steel material. Moreover, when the vane coated with the fine-particle-rich laminate B-DLC film (surface roughness Ra: 0.04 μm) was used, the friction loss was smaller than that when using the vane of a mirror-polished steel material (surface roughness Ra: 0.02 μm). It is thus considered that the friction loss reducing effect is attributable not only to the mere reduction of the surface roughness but also to the fact that the friction coefficient (μ) of the B-DLC film is small.

When the Mo-trinuclear-containing oil (800 ppmMo) was used, the friction loss torque of the vane of the reference steel material was 0.24 N·m, which is 11% lower than that when using the commercially available CVTF (Mo-trinuclear free). Moreover, when the Mo-trinuclear-containing oil (800 ppmMo) was used, the friction loss torque of the vane coated with the fine-particle-rich laminate B-DLC film was reduced to 0.19 N·m. This is a 31% reduction as compared with the friction loss torque when combining the vane of the reference steel material and the commercially available CVTF.

When the vane coated with the single-layer hydrogen-free DLC film was combined with the Mo-trinuclear-containing oil (800 ppmMo), film delamination occurred from the vane tip end after completion of the test, which revealed insufficient interfacial adhesion of the film. In this case, therefore, the friction loss evaluation was discontinued.

When the vane coated with the single-layer hydrogen-free DLC film was combined with the Mo-trinuclear-containing oil (300 ppmMo), the friction loss torque was 0.21 N·m, which is not comparable with the friction loss torque (0.19 N·m) when combining the fine-particle-rich laminate B-DLC film and the Mo-trinuclear-containing oil (800 ppmMo). Significant wear and delamination after the test were not recognized in the fine-particle-rich laminate B-DLC film also when combined with the Mo-trinuclear-containing oil (800 ppmMo), and it has thus been determined that the fine-particle-rich laminate B-DLC film has sufficient wear resistance.

The friction loss torque when combining the fine-particle-poor laminate B-DLC film with the Mo-trinuclear-containing oil (300 ppmMo) was 0.23 N·m. This is a 14% reduction as compared with the friction loss torque when combining the vane of the reference steel material and the commercially available CVTF (Mo-trinuclear free). In this test, the wear of the fine-particle-poor laminate B-DLC film was also small. However, the friction loss reducing effect was smaller than that when combining the fine-particle-rich laminate B-DLC film and the Mo-trinuclear-containing oil (800 ppmMo).

3.3 Analysis of Friction Loss Reducing Effect

The friction between the vanes and cam ring of the oil pump is considered to be in a mixed lubrication state. In this state, it is considered that the surface roughness of the sliding surface affects the formation state of the oil film and gets involved with the friction properties. The surface roughness Ra of each of various vanes and the counterpart cam ring before and after the oil pump test was measured.

3.3.1 Change in Surface Roughness of Vanes Before and after Test

Figure 18:
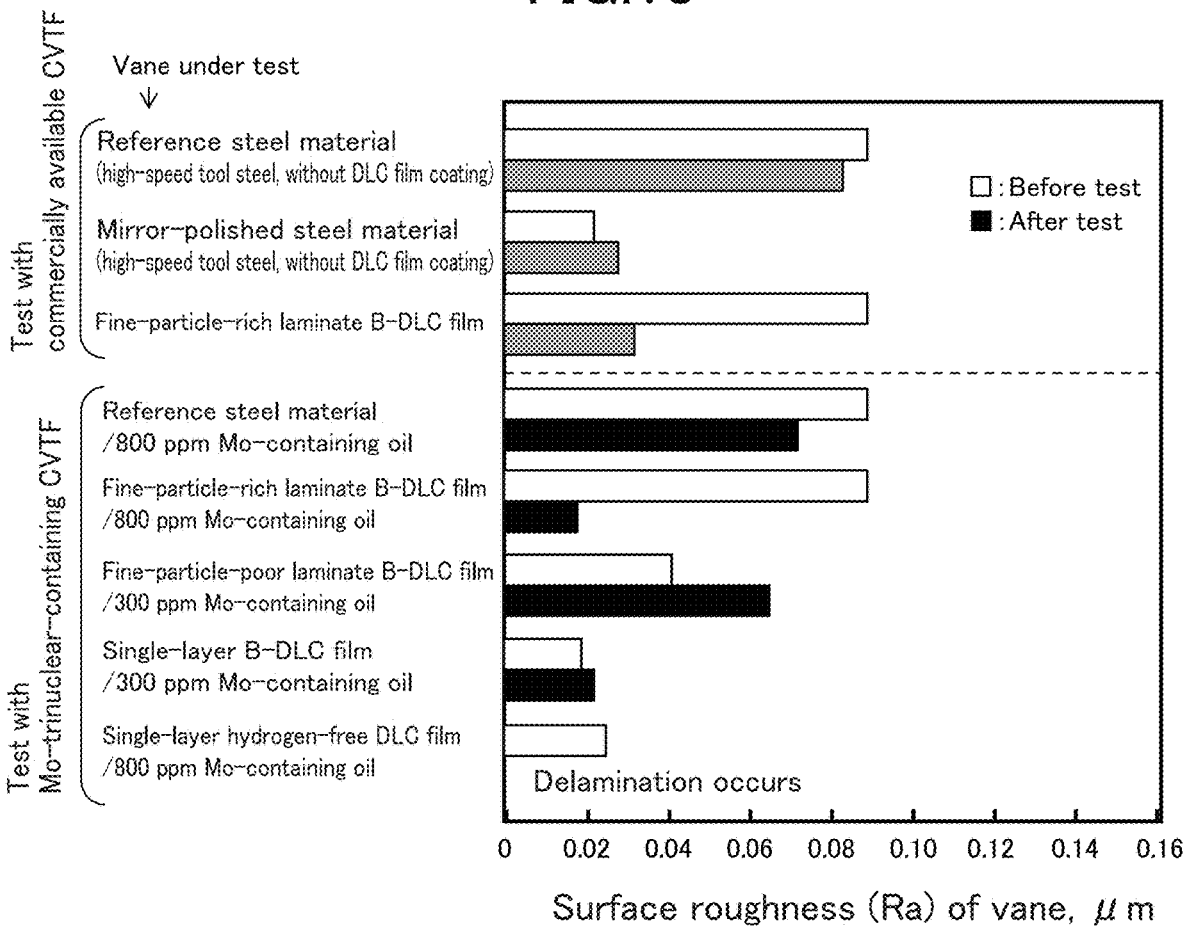
FIG. 18 is a bar graph illustrating the surface roughness of each vane before and after the oil pump test.

FIG. 18 collectively illustrates the surface roughness (Ra) of vanes before and after the oil pump test. FIG. 19 illustrates the surface roughness profiles of vanes after the oil pump test performed using the commercially available CVTF (Mo-trinuclear free oil). FIG. 20 illustrates the surface roughness profiles of vanes before and after the oil pump test performed using the Mo-trinuclear-containing oil. The single-layer hydrogen-free DLC film in which film delamination occurred in the test was excluded from this analysis.

As found from FIG. 18, the surface roughness of the vane coated with the fine-particle-rich laminate B-DLC film became small after the test. In particular, it is found that when combined with the Mo-trinuclear-containing oil (800 ppmMo), the surface roughness after the test becomes smaller than that of the mirror-polished steel material and is significantly smoothened. This can be considered as follows.

This appears to be because in the fine-particle-rich laminate B-DLC film, the wear and falling off of the protrusions on the surface may occur due to the fine particles while the transfer and excavation of the counterpart material are less likely to occur and, further, the B-DLC film moderately wears to be smoothened when combined with the Mo-trinuclear-containing oil (in particular, 800 ppmMo).

On the other hand, when the fine-particle-rich laminate B-DLC film is combined with the Mo-trinuclear-containing oil (300 ppmMo), the surface roughness after the test increases. This appears to be because, as illustrated in FIG. 20-3), recesses are formed due to falling off of the fine particles and smoothening of the B-DLC film is insufficient due to insufficient content of the Mo-trinuclear.

3.3.2 Change in Surface Roughness of Counterpart Cam Ring Before and after Test

Figure 21:
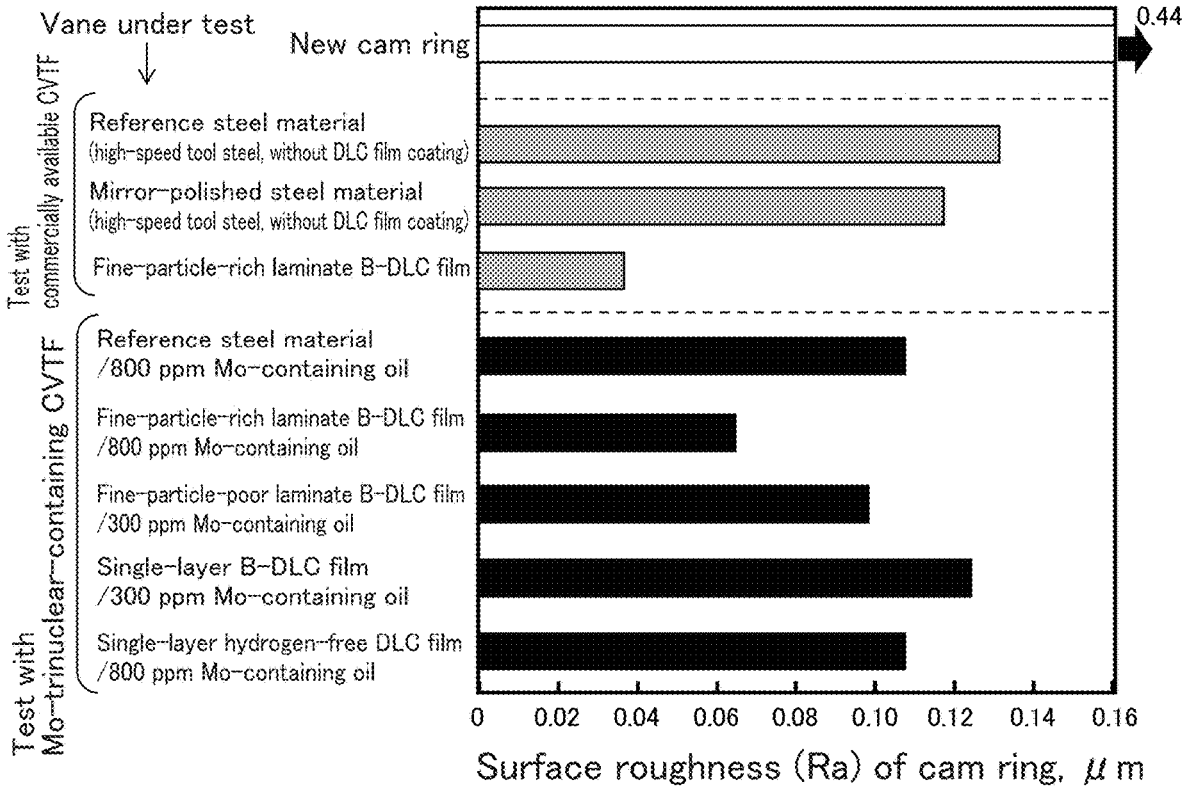
FIG. 21 is a bar graph illustrating the surface roughness of each cam ring before and after the oil pump test.

FIG. 21 collectively illustrates the surface roughness Ra of counterpart cam rings after the oil pump test and a new cam ring. FIG. 22 and FIG. 23 illustrate the surface roughness profiles of counterpart cam rings after the oil pump test performed by combining each vane with the commercially available CVTF (Mo-trinuclear free oil) or the Mo-trinuclear-containing oil, respectively. The surface roughness of the counterpart cam ring for the single-layer hydrogen-free DLC film in which the film delamination occurred during the test is also illustrated as a reference value.

As found from FIG. 21, the surface roughness (Ra) of the cam rings is all 0.14 or less from the initial 0.44 μm (of a new product) and is smoothened as a whole. However, the absolute values of the surface roughness of the cam rings are generally higher than the previously-described surface roughness of the vanes. It is thus found that when using the vane coated with the fine-particle-rich laminate B-DLC film, the roughness of the cam ring is significantly reduced regardless of the type of oil and the effect of smoothening the counterpart material is large.

Comparing the case in which the vane coated with the fine-particle-rich laminate B-DLC film is combined with the commercially available CVTF or the Mo-trinuclear-containing oil (800 ppmMo) with the case in which the fine-particle-poor laminate B-DLC film is combined with the Mo-trinuclear-containing oil (300 ppmMo), the surface roughness of the cam ring in the former case is smaller regardless of whether or not the Mo-trinuclear is contained. From this fact, it can be said that the laminate film containing a large amount of fine particles having a particle diameter of 0.5-5 μm or 1-5 μm has a larger polishing effect and a larger smoothening effect for the counterpart material.

However, as illustrated in FIG. 18 to FIG. 20, after the test of about 5 hours, the fine-particle-like protrusions of the fine-particle-containing laminate B-DLC film almost disappear, and the surface roughness is sufficiently small. It is therefore determined that the polishing effect on the cam ring by the vane coated with the fine-particle-containing laminate B-DLC film disappears at an early stage and the counterpart cam ring does not excessively wear.

3.3.3 Composite Surface Roughness of Vanes and Counterpart Cam Rings after Test

Figure 24:
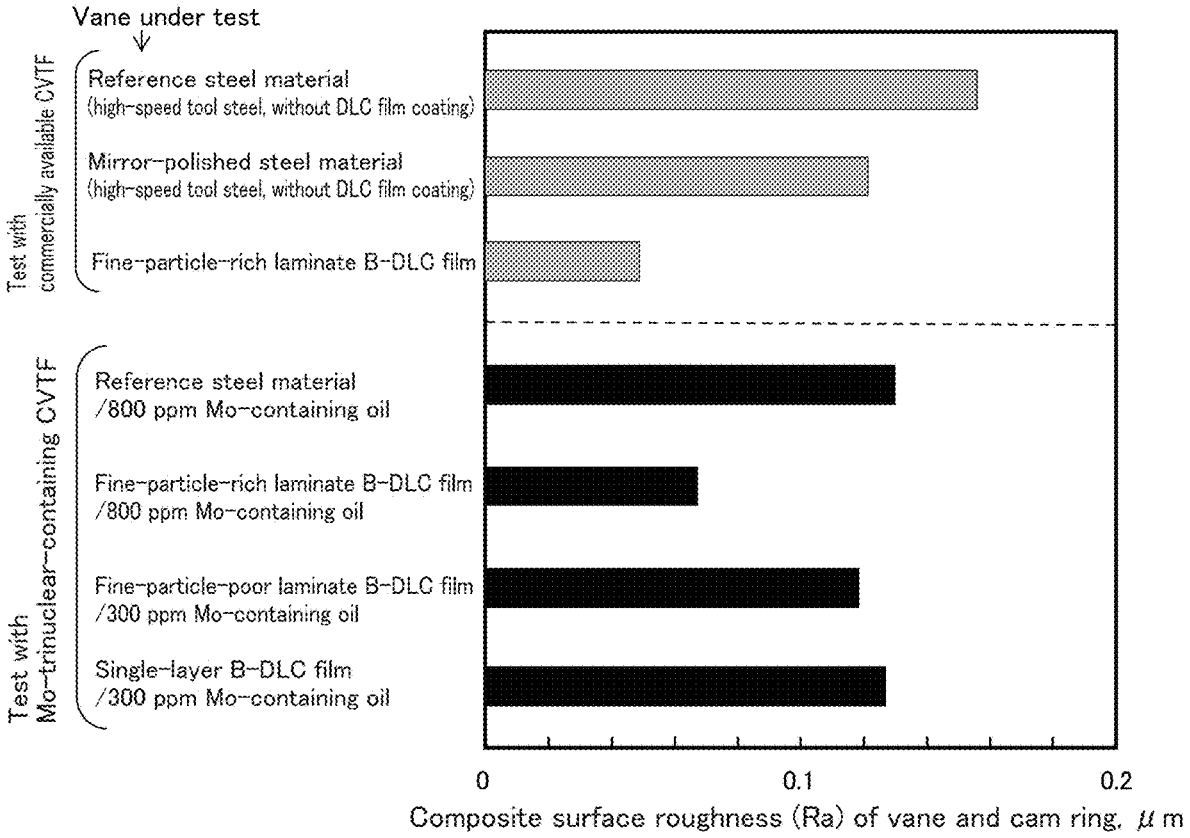
FIG. 24 is a bar graph illustrating the composite surface roughness of vanes and cam rings after the oil pump test.

FIG. 24 collectively illustrates the composite surface roughness (root mean square values) calculated from the surface roughness (Ra) of the vanes and counterpart cam rings after the oil pump test.

As found from FIG. 24, the composite surface roughness of the fine-particle-rich laminate B-DLC film is significantly smaller than the composite surface roughness of the reference steel material regardless of the type of oil. This tendency is the same as compared with that of the fine-particle-poor laminate B-DLC film.

The surface roughness of the vane of the mirror-polished material itself is small, but the smoothening effect on the counterpart cam ring is also small. The composite surface roughness is therefore not much reduced relative to the composite surface roughness of the reference steel material (without mirror polishing). Paying attention to the case in which the oil pump test is performed using the Mo-trinuclear-containing oil, the composite surface roughness of the single-layer B-DLC film and the fine-particle-poor laminate B-DLC film is comparable with that of the reference steel material. This is also considered to be due to the fact that the vane itself is smoothened while the smoothening of the counterpart cam ring is insufficient.

From the above results, it can be said that the fine-particle-rich laminate B-DLC film exhibits a particularly excellent smoothening effect on itself and on the counterpart material. It is considered that such smoothening of both the sliding surfaces reduces the ratio of solid contact and significantly contributes to the reduction in friction in the mixed lubrication state in which the oil film forming part and the solid contact part coexist.

Figure 25:
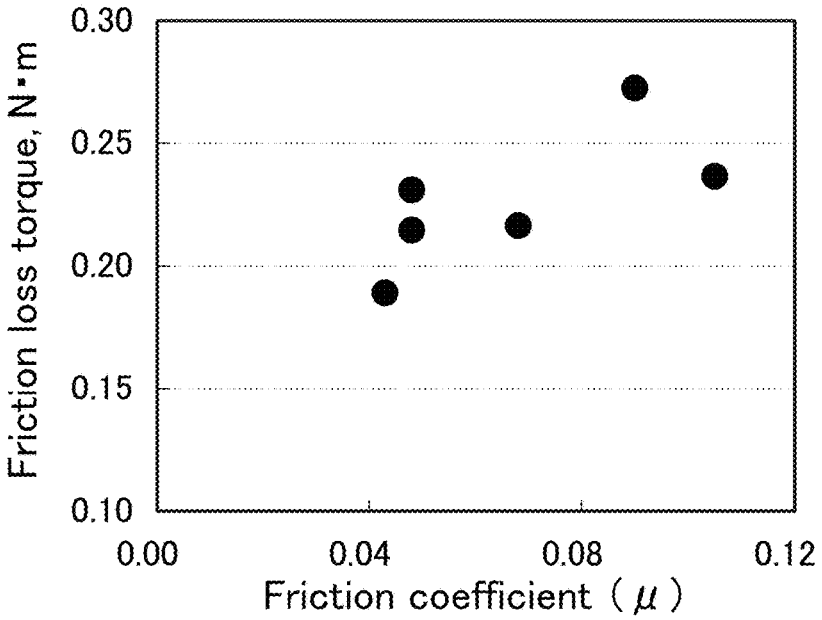
FIG. 25 is a scatter diagram illustrating the relationship between the friction loss torque in the oil pump test and the friction coefficient (μ) in the block-on-ring test.

3.3.4 Effects of Friction Properties of Sliding Members and Composite Surface Roughness of Vanes and Cam Rings on Friction Loss of Vane Oil Pump (1) FIG. 25 illustrates the relationship between the friction loss torque obtained from the oil pump test and the friction coefficient (μ) obtained from the block-on-ring test in an organized manner. FIG. 25 plots those in such a correspondence relationship that the combination of the reference steel material (high-speed tool steel), the fine-particle-rich laminate B-DLC film, the fine-particle-poor laminate B-DLC film, or the single-layer B-DLC film and the commercially available CVTF or the Mo-trinuclear-containing CVTF is the same in these tests.

Referring to FIG. 25, the friction loss torque and the friction coefficient are recognized to exhibit a tendency of a constantly increasing proportion, but the variation is large. It is therefore considered that the friction of the oil pump involves influential factors other than the friction coefficient obtained in the block-on-ring test. The block-on-ring test in the present examples was conducted in the mixed lubrication state, but in order to relatively evaluate the friction properties of the surface materials, the block-on-ring test was performed under the sliding condition mainly based on the boundary lubrication in which the influence of the oil viscosity is small.

Figure 26:
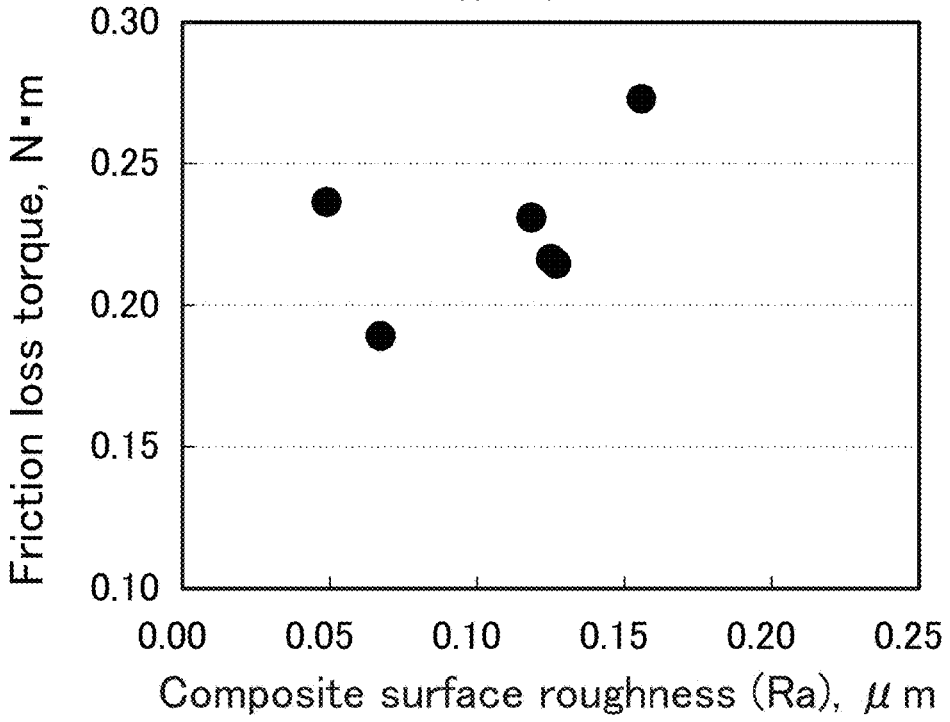
FIG. 26 is a scatter diagram illustrating the relationship between the friction loss torque in the oil pump test and the composite surface roughness of the vanes and cam rings after completion of the test.

(2) FIG. 26 collectively illustrates the relationship between the friction loss torque in the oil pump test and the composite surface roughness of the vanes and cam rings after completion of the test for the same combinations as in FIG. 25. From FIG. 26, a constantly increasing correlative relationship is generally recognized also between the friction loss torque and the composite surface roughness, but the variation is large and the relationship therebetween is unclear.

Figure 27:
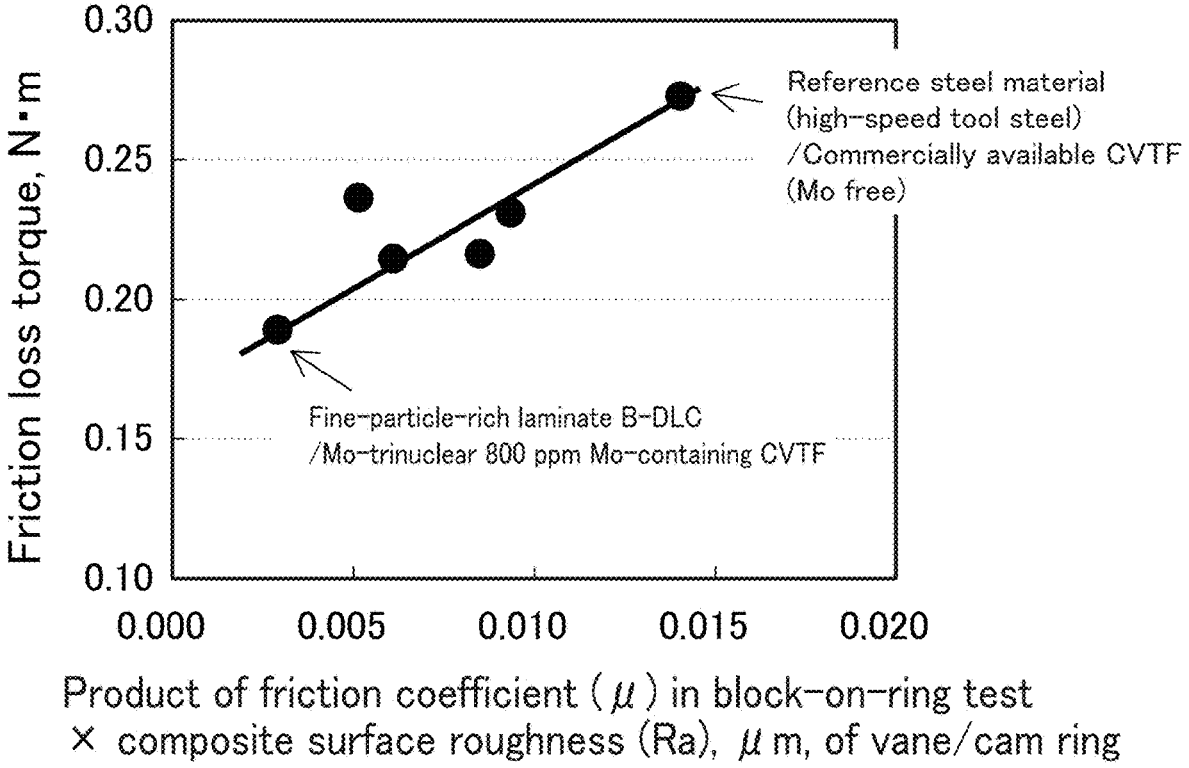
FIG. 27 is a scatter diagram illustrating the relationship between the product of the friction coefficient (μ) in the block-on-ring test x the composite surface roughness (Ra) of the vane/cam ring and the friction loss torque.

(3) FIG. 27 illustrates the relationship between the product of the friction coefficient (μ) in the block-on-ring test x the composite surface roughness (Ra) of the vane/cam ring and the friction loss torque. As found from FIG. 27, as the product of the friction coefficient (μ)×the composite surface roughness (Ra) decreases, the friction loss torque of the oil pump tends to also decrease. To reduce the friction of the oil pump, therefore, it may be effective to reduce the friction coefficient at the contact part between the vane and the cam ring and reduce the composite surface roughness by reducing the solid contact ratio.

In the fine-particle-containing laminate B-DLC film, it is considered that both the friction coefficient and the composite surface roughness at the solid contact part are reduced thereby to reduce the friction loss of the oil pump. In particular, it is considered that a particularly excellent friction loss reducing effect is developed when combining the fine-particle-rich laminate B-DLC film and the Mo-trinuclear-containing oil because in this case the friction coefficient and the composite surface roughness can be minimized.

For reference, the reason of organizing the product of "friction coefficient×composite surface roughness" is as follows.

The friction coefficient (μ) in the mixed lubrication state is represented by $\mu=\mu s\times\alpha+\mu f\times(1-\alpha)$, where a is a solid contact ratio (=load sharing ratio of the solid contact part, $0\leq\alpha\leq1$), μs is a friction coefficient of the solid contact part (boundary friction coefficient), and μf is a friction coefficient of the fluid part.

The solid contact ratio (a) is determined by the ratio of the oil film thickness, which is primarily dominated by the surface pressure, sliding speed, and oil viscosity, and the composite surface roughness of the surface, and its value decreases as the composite surface roughness becomes small.

In the oil pump test of the present examples, the shape of components, the hydraulic pressure, the pump rotation speed, and the oil temperature are the same, and the difference in viscosity of the used oils is small within a range of the content of the Mo-trinuclear of 800 ppmMo or less. It is therefore considered that the oil film thickness is approximately the same.

The friction coefficient (μf) of the fluid part is generally said to be 0.001 or less. If the friction coefficient (μs) of the solid contact part is assumed to be 0.05 or more as in the measured values of the block-on-ring test, the friction of the fluid part can be said to be sufficiently smaller than the friction of the solid contact part. The total friction can therefore be approximated by the friction at the solid contact part.

Under ordinary circumstances, the solid contact ratio (a) should be obtained by calculation based on the modified Reynolds equation of Patir-Cheng, the mixed fluid lubrication theory of Greenwood-Tripp, and the like. However, there is a relationship that a decreases as the composite surface roughness decreases. In the present examples, therefore, the composite surface roughness without modification was used as substitute for a and the friction coefficient in the block-on-ring test was used as substitute for μs so that qualitative interpretation was able to be easily performed.

TABLE 1

| Type of DLC film | DLC film thickness, μm | Film formation method |
|---|---|---|
| Fine-particle-rich laminate B-DLC film | 2.4 (upper layer: 1.1, lower layer: 1.3) | Sputtering (upper layer) + cathode arc (lower layer) |
| Fine-particle-poor laminate B-DLC film | 1.8 (upper layer: 1.0, lower layer: 0.8) | |
| Single-layer B-DLC film | 1.8 | Sputtering |
| Single-layer hydrogen-free DLC film | 1.0 | Cathode arc |

TABLE 2

| | Number of fine-particle-like protrusions | | |
|---|---|---|---|
| Type of DLC film | Particle diameter of 0.5-5 μm, Number/100 $\mu m^2$ | Particle diameter of 1-5 μm, Number/100 $\mu m^2$ | Particle diameter of 2-5 μm, Number/100 $\mu m^2$ |
| Fine-particle-rich laminate B-DLC film | 38 | 15 | 4.8 |
| Fine-particle-poor laminate B-DLC film | 12 | 4 | 1.5 |
| Single-layer B-DLC film | 1 or less | 1 or less | 0.1 |
| Single-layer hydrogen-free DLC film | 1 or less | 1 or less | 0.0 |

TABLE 3

| Type of DLC film | | Film composition, atom % Boron (B) | Hydrogen (H) | Carbon (C) | Hardness, GPa |
|---|---|---|---|---|---|
| Fine-particle-rich laminate B-DLC film | Upper layer | 10 | 12 | Balance | 23 |
| | Lower layer | 0 | 2 or less | Balance | 59 |
| Fine-particle-poor laminate B-DLC film | Upper layer | 17 | 12 | Balance | Not-measured |
| | Lower layer | 0 | 2 or less | Balance | 59 |
| Single-layer B-DLC film | | 10 | 2 or less | Balance | 23 |
| Single-layer hydrogen-free DLC film | | 0 | 2 or less | Balance | 58 |

TABLE 4

| Analyzed site | Overview of analyzed site | Peak intensity of carbon bond state, Intensity (a.u.) $\pi^*$ | $\sigma^*$ | $\pi^*/(\pi^* + \sigma^*)$ |
|---|---|---|---|---|
| (A) of FIG. 9-1 | Fine particle part of about 2 μm Φ | 31757583 | 254955635 | 0.1108 |
| (B) of FIG. 9-2 | Fine particle part of about 0.5 μm Φ | 15749721 | 274816997 | 0.0542 |
| (C) of FIG. 9-2 | Hydrogen-free DLC film part of lower layer | 12729993 | 298384159 | 0.0409 |

Supplement) Peak area of $\pi^*$ is calculated within range of 282 eV-288 eV and peak area of $\pi^* + \sigma^*$ is calculated within range of 282eV-310eV.

TABLE 5

| Component under test | | Surface roughness (Ra), μm Optically measured roughness | Stylus type measured roughness (reference value) |
|---|---|---|---|
| Vane | Fine-particle-rich laminate B-DLC film | 0.09 | 0.19 |
| | Fine-particle-poor laminate B-DLC film | 0.04 | 0.13 |
| | Single-layer B-DLC film | 0.02 | 0.04 |
| | Single-layer hydrogen-free DLC film | 0.03 | 0.06 |
| | Reference steel material (without DLC film coating) | 0.09 | 0.06 |
| | Mirror-polished steel material (without DLC film coating) | 0.02 | 0.05 |
| Cam ring (sintered steel material, phosphate treatment) | | 0.54 | 0.44 |

TABLE 6

| Component under test | | Surface roughness (Ra), μm [Optically measured value] |
|---|---|---|
| Block test piece | Fine-particle-rich laminate B-DLC film | 0.03 |
| | Fine-particle-poor laminate B-DLC film | 0.03 |
| | Single-layer B-DLC film | 0.01 |
| | Single-layer hydrogen-free DLC film | 0.02 |
| | Reference steel material (without DLC film coating) | 0.01 |

The invention claimed is:

1. A sliding member having a sliding surface sliding under a wet condition in which a lubricant oil exists, the sliding surface being coated with a laminate film comprising an upper layer and a lower layer, the lower layer comprising hydrogen-free amorphous carbon (referred to as "hydrogen-free DLC") and carbon particles dispersed on or in the hydrogen-free DLC and having a hydrogen content of 5 atom % or less when the lower layer as a whole is 100 atom %, the upper layer comprising boron-containing amorphous carbon (referred to as "B-DLC") and having protrusions on a surface side of the upper layer along the carbon particles of the lower layer, the B-DLC having a boron content of 1-40 atom % when the upper layer as a whole is 100 atom %, the protrusions having a particle diameter of 0.5-5 μm and existing with a density of 20 protrusions/100 $\mu m^2$ or more.

2. The sliding member as recited in claim 1, wherein the B-DLC has a thickness of 0.2-3 μm, and the hydrogen-free DLC has a thickness of 0.5-5 μm.

3. The sliding member as recited in claim 1, wherein the B-DLC has hardness of 15-35 GPa, and the hydrogen-free DLC has hardness of 40-70 GPa.

4. A sliding machine comprising:

a pair of sliding members having sliding surfaces that can relatively move while facing each other; and a lubricant oil interposed between the sliding surfaces facing each other, at least one of the sliding members comprising the sliding member as recited in claim 1.

5. The sliding machine as recited in claim 4, wherein the sliding machine is an oil pump that pumps the lubricant oil under pressure.

6. The sliding machine as recited in claim 5, wherein the pair of sliding members are a vane and a cam ring, the oil pump is a vane pump, and the vane has the sliding surface coated with the laminate film on a tip end side of the vane.

7. The sliding machine as recited in claim 6, wherein the cam ring comprises an iron-based sintered material.

8. The sliding machine as recited in claim 4, wherein the lubricant oil contains an oil-soluble molybdenum compound with a mass ratio of Mo to the lubricant oil as a whole of 200-1000 ppm, wherein the oil-soluble molybdenum compound has a chemical structure comprising a trinuclear of Mo.

* * * * *